US010080929B2

(12) United States Patent
Takihara et al.

(10) Patent No.: US 10,080,929 B2
(45) Date of Patent: Sep. 25, 2018

(54) GOLF BALL

(71) Applicant: SUMITOMO RUBBER INDUSTRIES, LTD., Kobe-shi, Hyogo (JP)

(72) Inventors: Hironori Takihara, Kobe (JP); Takahiro Sajima, Kobe (JP); Kohei Mimura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/624,328

(22) Filed: Jun. 15, 2017

(65) Prior Publication Data

US 2018/0028873 A1 Feb. 1, 2018

(30) Foreign Application Priority Data

Jul. 26, 2016 (JP) ..... 2016-146185

(51) Int. Cl.
*A63B 37/06* (2006.01)
*A63B 37/00* (2006.01)

(52) U.S. Cl.
CPC ..... *A63B 37/0092* (2013.01); *A63B 37/002* (2013.01); *A63B 37/0006* (2013.01); *A63B 37/008* (2013.01); *A63B 37/0017* (2013.01); *A63B 37/0019* (2013.01); *A63B 37/0021* (2013.01); *A63B 37/0031* (2013.01); *A63B 37/0033* (2013.01); *A63B 37/0043* (2013.01); *A63B 37/0045* (2013.01); *A63B 37/0062* (2013.01); *A63B 37/0075* (2013.01); *A63B 37/0076* (2013.01); *A63B 37/0094* (2013.01); *A63B 37/0096* (2013.01); *A63B 37/0012* (2013.01); *A63B 37/0063* (2013.01)

(58) Field of Classification Search
CPC ..... A63B 34/0006
USPC ..... 473/383
See application file for complete search history.

(56) References Cited

U.S. PATENT DOCUMENTS

| | | | | |
|---|---|---|---|---|
| 2007/0149321 | A1 | 6/2007 | Sajima | |
| 2007/0173354 | A1 | 7/2007 | Sajima | |
| 2009/0191982 | A1 | 7/2009 | Kim et al. | |
| 2011/0034274 | A1* | 2/2011 | Sajima | A63B 37/0006 473/384 |
| 2012/0004053 | A1 | 1/2012 | Kim | |

(Continued)

FOREIGN PATENT DOCUMENTS

JP 2010-188199 A 9/2010

*Primary Examiner* — Raeann Gorden
(74) *Attorney, Agent, or Firm* — Birch, Stewart, Kolasch & Birch, LLP

(57) ABSTRACT

A golf ball 2 includes a core 4, one or more mid layers 6, a cover 8, and dimples 10. A central hardness Ho and a surface hardness Hs of the core 4, a hardness Hm(min) of a layer having a lowest hardness among the mid layers 6, and a hardness Hc of the cover 8 satisfy the following mathematical formulas (1) to (4).

$$Hs-Ho>15 \quad (1)$$

$$Hc-Hm(\min)>20 \quad (2)$$

$$-10<Hm(\min)-Ho<15 \quad (3)$$

$$5<Hc-Hs<20 \quad (4)$$

An occupation ratio So and a ratio Rs of a number of the dimples 10 each having a diameter of from 9.60% to 10.37% of a diameter of the golf ball 2, relative to a total number of the dimples 10, satisfy the following mathematical formula (5).

$$Rs\geq-2.5*So+273 \quad (5).$$

9 Claims, 26 Drawing Sheets

(56) References Cited

U.S. PATENT DOCUMENTS

| | | | | |
|---|---|---|---|---|
| 2013/0005505 | A1* | 1/2013 | Sajima | C08K 5/09<br>473/372 |
| 2013/0196791 | A1 | 8/2013 | Sajima et al. | |

* cited by examiner

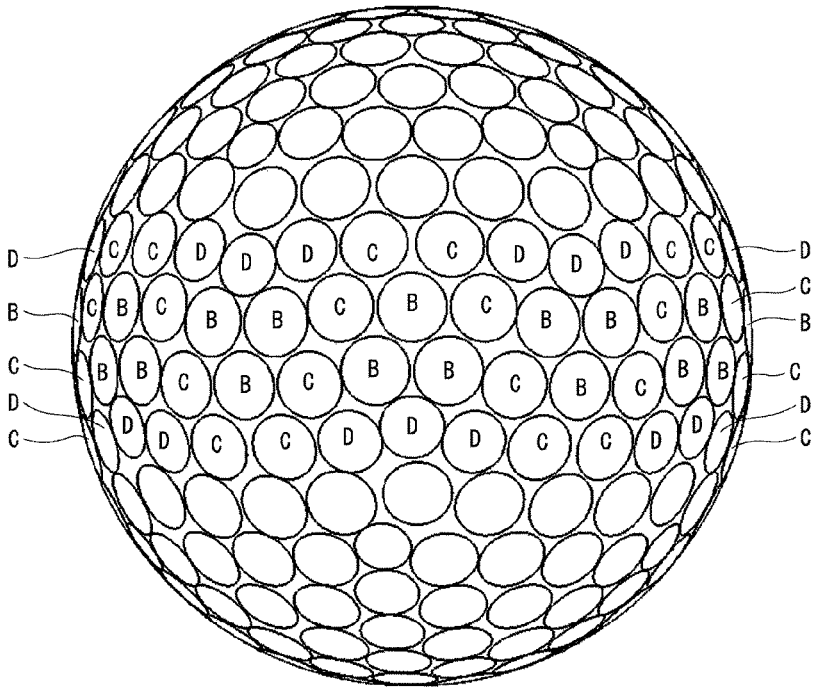
D
B
C
D
C
D
C
B
C
D
C
B
C
B
C
B

GOLF BALL

This application claims priority on Patent Application No. 2016-146185 filed in JAPAN on Jul. 26, 2016. The entire contents of this Japanese Patent Application are hereby incorporated by reference.

BACKGROUND OF THE INVENTION

Field of the Invention

The present invention relates to golf balls. Specifically, the present invention relates to golf balls including a core, one or more mid layers, a cover, and dimples.

Description of the Related Art

The greatest interest to golf players concerning golf balls is flight distance. In particular, golf players place importance on flight distances upon shots with a driver. There have been various proposals for improvement of flight performance. JP2010-188199 discloses a golf ball including a core having a high hardness at the surface thereof and a low hardness at the central point thereof. When the golf ball is hit with a driver, the spin rate is low.

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

There have been various proposals for dimples. JP2009-172192 (US2009/0191982) discloses a golf ball on which dimples are randomly arranged. The dimple pattern of the golf ball is referred to as a random pattern. The random pattern can contribute to the flight performance of the golf ball. JP2012-10822 (US2012/0004053) also discloses a golf ball having a random pattern.

JP2007-175267 (US2007/0149321) discloses a dimple pattern in which the number of units in a high-latitude region is different from the number of units in a low-latitude region. JP2007-195591 (US2007/0173354) discloses a dimple pattern in which the number of the types of dimples in a low-latitude region is larger than the number of the types of dimples in a high-latitude region. JP2013-153966 (US2013/0196791) discloses a dimple pattern having a high dimple density and small variation in dimple size.

In golf, a golf ball is hit with a wood type club, an iron type club, a hybrid type club (utility), a putter, or the like. The feel at impact upon hitting is an interest to golf players. Generally, golf players desire golf balls having soft feel at impact.

Upon hitting with a wood type club, an iron type club, or a hybrid type club, the frequency of a missed shot is high. Therefore, golf players are insensitive to the feel at impact when hitting golf balls with these clubs.

Meanwhile, upon putting, a golf ball is often hit at the sweet spot of a putter. Golf players are sensitive to the feel at impact upon putting. Golf players desire golf balls that provides soft feel at impact upon putting.

An object of the present invention is to provide a golf ball having excellent flight performance upon a shot with a driver and excellent feel at impact upon putting.

SUMMARY OF THE INVENTION

A golf ball according to the present invention includes a core, one or more mid layers positioned outside the core, and a cover positioned outside the mid layers. A Shore C hardness Ho at a central point of the core, a Shore C hardness Hs at a surface of the core, a Shore C hardness Hm(min) of a layer having a lowest hardness among the mid layers, and a Shore C hardness Hc of the cover satisfy the following mathematical formulas (1) to (4).

$$Hs-Ho>15 \quad (1)$$

$$He-Hm(\min)>20 \quad (2)$$

$$-10<Hm(\min)-Ho<15 \quad (3)$$

$$5<Hc-Hs<20 \quad (4)$$

The hardness He of the cover is higher than a Shore C hardness Hm(max) of a layer having a highest hardness among the mid layers. The golf ball has a plurality of dimples on a surface thereof. A ratio So of a sum of areas of the dimples relative to a surface area of a phantom sphere of the golf ball is not less than 81.0%. A ratio Rs of a number of the dimples each having a diameter of not less than 9.60% and not greater than 10.37% of a diameter of the golf ball, relative to a total number, of the dimples, is not less than 50%. A dimple pattern of each hemisphere of the phantom sphere includes three units that are rotationally symmetrical to each other. A dimple pattern of each unit includes two small units that are mirror-symmetrical to each other. The golf ball satisfies the following mathematical formula (5).

$$Rs\geq-2.5*So+273 \quad (5)$$

The golf ball according to the present invention has excellent resilience performance when being hit with a driver. When the golf ball is hit with a driver, the spin rate is low. Furthermore, the dimple pattern of the golf ball has an excellent aerodynamic characteristic. The golf ball has excellent flight performance when being hit with a driver.

When the golf ball is hit with a putter, the shock is small. When the golf ball is hit with a putter, the feel at impact is soft.

The golf ball is excellent in both flight performance when being hit with a driver and feel at impact when being hit with a putter.

Preferably, a sum of a thickness of the cover and thicknesses of all the mid layers is not greater than 2.8 mm.

Preferably, the golf ball satisfies the following mathematical formula (6).

$$Rs\geq-2.5*So+278 \quad (6)$$

Preferably, the golf ball satisfies the following mathematical formula (7).

$$Rs\geq-2.5*So+283 \quad (7)$$

Preferably, a ratio Rs' of a number of the dimples each having a diameter of not less than 10.10% and not greater than 10.37% of the diameter of the golf ball, relative to the total number of the dimples, is not less than 50%. Preferably, the golf ball satisfies the following mathematical formula (8).

$$Rs'\geq-2.2*So+245 \quad (8)$$

Preferably, the golf ball satisfies the following mathematical formula (9).

$$Rs' \geq -2.2*So+252 \quad (9)$$

Preferably, a depth of a deepest part of each dimple from a surface of the phantom sphere is not less than 0.10 mm and not greater than 0.65 mm.

Preferably, a total volume of the dimples is not less than 450 $mm^3$ and not greater than 750 $mm^3$.

Preferably, the Shore C hardness Ho at the central point of the core is not less than 40 and not greater than 60, and the Shore C hardness Hs at the surface of the core is not less than 70 and not greater than 90.

Preferably, a difference (Hc−Hm(max)) between the hardness Hc of the cover and the Shore C hardness Hm(max) of the layer having the highest hardness among the mid layers is not less than 5 and not greater than 45.

BRIEF DESCRIPTION OF THE DRAWINGS

FIG. 26 is a front view of the golf ball in FIG. 25.

DESCRIPTION OF THE PREFERRED EMBODIMENTS

The following will describe in detail the present invention based on preferred embodiments with appropriate reference to the drawings.

Figure 1:
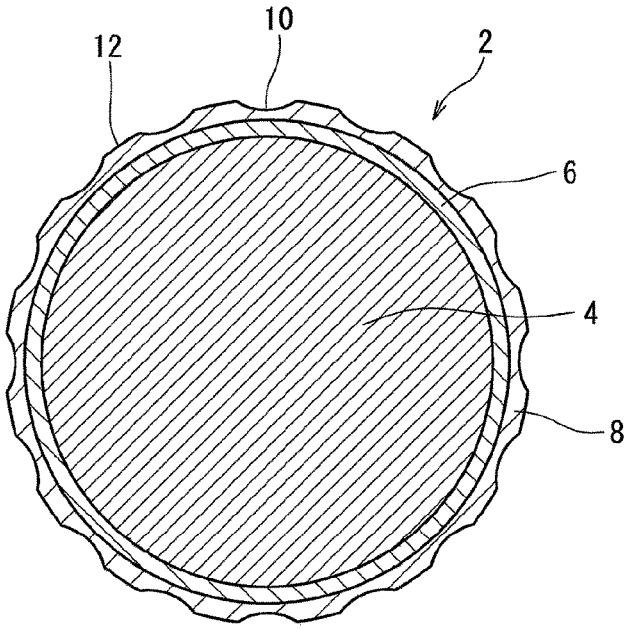
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. The golf ball 2 has a plurality of dimples 10 on the surface thereof. Of the surface of the golf ball 2, a part other than the dimples 10 is a land 12. The golf ball 2 includes a paint layer and a mark layer on the external side of the cover 8 although these layers are not shown in the drawing. The golf ball 2 may include another layer between the core 4 and the mid layer 6. The golf ball 2 may include another layer between the mid layer 6 and the cover 8.

The golf ball 2 preferably has a diameter of not less than 40 mm and not greater than 45 mm. From the standpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The golf ball 2 preferably has a weight of not less than 40 g and not greater than 50 g. In light of attainment of great inertia, the weight is more preferably not less than 44 g and particularly preferably not less than 45.00 g. From the standpoint of conformity to the rules established by the USGA, the weight is particularly preferably not greater than 45.93 g.

The core 4 is formed by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferable. When a polybutadiene and another rubber are used in combination, it is preferred if the polybutadiene is a principal component. Specifically, the proportion of the polybutadiene to the entire base rubber is preferably not less than 50% by weight and particularly preferably not less than 80% by weight. A polybutadiene in which the proportion of cis-1,4 bonds is not less than 80% is particularly preferable.

The rubber composition of the core 4 preferably includes a co-crosslinking agent. Preferable co-crosslinking agents in light of resilience performance are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance, zinc acrylate and zinc methacrylate are particularly preferable.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the co-crosslinking agent per 100 parts by weight of the base rubber is preferably not less than 10 parts by weight and particularly preferably not less than 15 parts by weight. In light of soft feel at impact upon putting, the amount is preferably not greater than 50 parts by weight and particularly preferably not greater than 45 parts by weight.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

In light of resilience performance of the golf ball 2, the amount of the organic peroxide per 100 parts by weight of the base rubber is preferably not less than 0.1 parts by weight, more preferably not less than 0.3 parts by weight, and particularly preferably not less than 0.5 parts by weight. In light of soft feel at impact upon putting, the amount is preferably not greater than 3.0 parts by weight, more preferably not greater than 2.8 parts by weight, and particularly preferably not greater than 2.5 parts by weight.

Preferably, the rubber composition of the core 4 includes an organic sulfur compound. Organic sulfur compounds include naphthalenethiol compounds, benzenethiol compounds, and disulfide compounds.

Examples of naphthalenethiol compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance of the golf ball 2, the amount of the organic sulfur compound per 100 parts by weight of the base rubber is preferably not less than 0.1 parts by weight and particularly preferably not less than 0.2 parts by weight. In light of soft feel at impact upon putting, the amount is preferably not greater than 1.5 parts by weight, more preferably not greater than 1.0 parts by weight, and particularly preferably not greater than 0.8 parts by weight. Two or more organic sulfur compounds may be used in combination. A naphthalenethiol compound and a disulfide compound are preferably used in combination.

Preferably, the rubber composition of the core 4 includes a carboxylic acid or a carboxylate. The core 4 including a carboxylic acid or a carboxylate has a low hardness around the central point thereof. The core 4 has an outer-hard/inner-soft structure. When the golf ball 2 including the core 4 is hit with a driver, the spin rate is low. With the golf ball 2 having a low spin rate, a large flight distance is obtained. Examples of preferable carboxylic acids include benzoic acid. Examples of preferable carboxylates include zinc octoate and zinc stearate. The rubber composition particularly preferably includes benzoic acid. The amount of the carboxylic acid and/or the carboxylate per 100 parts by weight of the base rubber is preferably not less than 1 parts by weight and not greater than 20 parts by weight.

The rubber composition of the core 4 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the core 4 is accomplished. The rubber composition may include various additives, such as sulfur, an anti-aging agent, a coloring agent, a plasticizer, a dispersant, and the like, in an adequate amount. The rubber composition may include crosslinked rubber powder or synthetic resin powder.

The core 4 preferably has a diameter of not less than 38.0 mm. The golf ball 2 including the core 4 having a diameter of not less than 38.0 mm has excellent resilience performance. In this respect, the diameter is more preferably not less than 38.5 mm and particularly preferably not less than 39.5 mm. From the standpoint that the mid layer 6 and the cover 8 can have sufficient thicknesses, the diameter is preferably not greater than 41.0 mm and particularly preferably not greater than 40.5 mm.

The core 4 has a weight of preferably not less than 10 g and not greater than 40 g. The temperature for crosslinking the core 4 is not lower than 140° C. and not higher than 180° C. The time period for crosslinking the core 4 is not shorter than 10 minutes and not longer than 60 minutes. The core 4 may have two or more layers. The core 4 may have a rib on the surface thereof. The core 4 may be hollow.

In the golf ball 2, the difference (Hs−Ho) between a hardness Hs at the surface of the core 4 and a hardness Ho at the central point of the core 4 exceeds 15. In other words, the golf ball 2 satisfies the following mathematical formula (1).

$$Hs-Ho>15 \quad (1)$$

The core 4 that satisfies the mathematical formula (1) has a so-called outer-hard/inner-soft structure. When the golf ball 2 including the core 4 is hit with a driver, the spin is suppressed. When the golf ball 2 including the core 4 is hit with a driver, a high launch angle is obtained.

Upon a shot with a driver, an appropriate trajectory height and appropriate flight duration are required. With the golf ball 2 that achieves a desired trajectory height and desired flight duration at a high spin rate, the run after landing is short. With the golf ball 2 that achieves a desired trajectory height and desired flight duration at a high launch angle, the run after landing is long. In light of flight distance, the golf ball 2 that achieves a desired trajectory height and desired flight duration at a high launch angle is preferable. The core 4 having an outer-hard/inner-soft structure can contribute to a high launch angle and a low spin rate as described above. The golf ball 2 including the core 4 has excellent flight performance.

In light of flight performance, the difference (Hs−Ho) is preferably not less than 17 and particularly preferably not less than 19. In light of ease of producing the core 4, the difference (Hs−Ho) is preferably not greater than 50 and particularly preferably not greater than 45.

In light of resilience performance, the central hardness Ho is preferably not less than 40, more preferably not less than 43, and particularly preferably not less than 46. In light of spin suppression and in light of feel at impact upon putting, the hardness Ho is preferably not greater than 60, more preferably not greater than 57, and particularly preferably not greater than 54.

The hardness Ho is measured with a Shore C type hardness scale mounted to an automated hardness meter (trade name "digi test II" manufactured by Heinrich Bareiss Prüfgerätebau GmbH). The hardness scale is pressed against the central point of the cross-section of a hemisphere obtained by cutting the golf ball 2. The measurement is conducted in an environment of 23° C.

In light of spin suppression, the surface hardness Hs is preferably not less than 70, more preferably not less than 72, and particularly preferably not less than 74. In light of durability of the golf ball 2, the hardness Hs is preferably not greater than 90, more preferably not greater than 88, and particularly preferably not greater than 86.

The hardness Hs is measured with a Shore C type hardness scale mounted to an automated hardness meter (trade name "digi test II" manufactured by Heinrich Bareiss Prüfgerätebau GmbH). The hardness scale is pressed against the surface of the core 4. The measurement is conducted in an environment of 23° C.

The mid layer 6 is positioned between the core 4 and the cover 8. The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 that includes the mid layer 6 including an ionomer resin has excellent resilience performance.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the mid layer 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferable. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably not less than 10% by weight, more preferably not less than 12% by weight, and particularly preferably not less than 15% by weight. In light of feel at impact of the golf ball 2, the content is preferably not greater than 50% by weight, more preferably not greater than 47% by weight, and particularly preferably not greater than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. The alloy can contribute to the resilience performance of the golf ball 2. An olefin having 2 to 10 carbon atoms is preferable. Examples of suitable olefins include ethylene, propylene, butene, and pentene. Ethylene and propylene are particularly preferable.

Specific examples of polymer alloys include trade names "RABALON T3221C", "RABALON T3339C", "RABALON SJ4400N", "RABALON SJ5400N", "RABALON SJ6400N", "RABALON SJ7400N", "RABALON SJ8400N", "RABALON SJ9400N", and "RABALON SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "SEPTON HG-252" manufactured by Kuraray Co., Ltd.

In light of feel at impact upon putting, the proportion of the styrene block-containing thermoplastic elastomer to the entire base polymer is preferably not less than 5% by weight, more preferably not less than 15% by weight, and particularly preferably not less than 20% by weight. In light of resilience performance of the golf ball 2, the proportion is preferably not greater than 70% by weight, more preferably not greater than 60% by weight, and particularly preferably not greater than 55% by weight.

The resin composition of the mid layer 6 may include a filler for the purpose of specific gravity adjustment and the like. Examples of suitable fillers include zinc oxide, barium sulfate, calcium carbonate, and magnesium carbonate. The resin composition may include powder of a metal with a high specific gravity. Specific examples of metals with a high specific gravity include tungsten and molybdenum. The amount of the filler is determined as appropriate so that the intended specific gravity of the mid layer 6 is accomplished. The resin composition may include a coloring agent, cross-linked rubber powder, or synthetic resin powder. When the hue of the golf ball 2 is white, a typical coloring agent is titanium dioxide.

The mid layer 6 preferably has a hardness Hm of not less than 40 and not greater than 90. The golf ball 2 that includes the mid layer 6 having a hardness Hm of not less than 40 has excellent resilience performance. In this respect, the hardness Hm is more preferably not less than 50 and particularly preferably not less than 55. The golf ball 2 that includes the mid layer 6 having a hardness Hm of not greater than 90 has excellent feel at impact upon putting. In this respect, the hardness Hm is more preferably not greater than 85 and particularly preferably not greater than 83. In the case where the golf ball 2 includes two or more mid layers 6, each mid layer 6 preferably has a hardness within the above range.

The hardness Hm is measured according to the standards of "ASTM-D 2240-68". The hardness Hm is measured with a Shore C type hardness scale mounted to an automated hardness meter (trade name "digi test II" manufactured by Heinrich Bareiss Prüfgerätebau GmbH). For the measurement, a sheet that is formed by hot press, is formed from the same material as that of the mid layer 6, and has a thickness of about 2 mm is used. Prior to the measurement, a sheet is kept at 23° C. for two weeks. At the measurement, three sheets are stacked.

In the present embodiment, the number of mid layers is one. Therefore, a Shore C hardness Hm(min) of the layer having the lowest hardness among the mid layers is equal to the above-described hardness Hm. A Shore C hardness Hm(max) of the layer having the highest hardness among the mid layers is equal to the above-described hardness Hm. In the present embodiment, the hardness Hm(min) is equal to the hardness Hm(max).

The mid layer 6 preferably has a thickness Tm of not less than 0.3 mm and not greater than 2.5 mm. The golf ball 2 that includes the mid layer 6 having a thickness Tm of not less than 0.3 mm has excellent feel at impact upon putting. In this respect, the thickness Tm is more preferably not less than 0.5 mm and particularly preferably not less than 0.8 mm. The golf ball 2 that includes the mid layer 6 having a thickness Tm of not greater than 2.5 mm has excellent resilience performance. In this respect, the thickness Tm is more preferably not greater than 2.0 mm and particularly preferably not greater than 1.8 mm. The thickness Tm is measured at a position immediately below the land 12. In the case where the golf ball 2 includes two or more mid layers 6, each mid layer 6 preferably has a thickness within the above range.

The cover 8 is the outermost layer except the mark layer and the paint layer. The cover 8 is formed from a resin composition. A preferable base polymer of the resin composition is an ionomer resin. The golf ball 2 that includes the cover 8 including the ionomer resin has excellent resilience performance. The ionomer resins described above for the mid layer 6 can be used for the cover 8.

An ionomer resin and another resin may be used in combination. Examples of the resin used in combination with the ionomer resin include polyurethanes, polyesters, polyamides, polyolefins, and polystyrenes. In this case, in light of resilience performance, the ionomer resin is included as the principal component of the base polymer. The proportion of the ionomer resin to the entire base polymer is preferably not less than 50% by weight, more preferably not less than 60% by weight, and particularly preferably not less than 70% by weight.

The resin composition of the cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

In light of spin suppression, the cover 8 has a Shore C hardness Hc of preferably not less than 76, more preferably not less than 79, and particularly preferably not less than 82. In light of feel at impact upon putting, the hardness Hc is preferably not greater than 97, more preferably not greater than 95, and particularly preferably not greater than 93.

The hardness Hc of the cover 8 is measured according to the standards of "ASTM-D 2240-68". The hardness He is measured with a Shore C type hardness scale mounted to an automated hardness meter (trade name "digi test II" manufactured by Heinrich Bareiss Prüfgerätebau GmbH). For the measurement, a sheet that is formed by hot press, is formed from the same material as that of the cover 8, and has a thickness of about 2 mm is used. Prior to the measurement, a sheet is kept at 23° C. for two weeks. At the measurement, three sheets are stacked.

In light of resilience performance of the golf ball 2, the cover 8 has a thickness Tc of preferably not less than 0.5 mm, more preferably not less than 0.7 mm, and particularly preferably not less than 0.8 mm. In light of feel at impact upon putting, the thickness Tc is preferably not greater than 2.0 mm, more preferably not greater than 1.5 mm, and particularly preferably not greater than 1.0 mm. The thickness Tc is measured at a position immediately below the land 12.

For forming the cover 8, known methods such as injection molding, compression molding, and the like can be used. When forming the cover 8, the dimples 10 are formed by pimples formed on the cavity face of a mold.

The golf ball 2 preferably has an amount of compressive deformation Sb of not less than 2.5 mm and not greater than 4.5 mm. The golf ball 2 having an amount of compressive deformation of not less than 2.5 mm has excellent feel at impact upon putting. In this respect, the amount of compressive deformation Sb is preferably not less than 2.7 mm and particularly preferably not less than 2.8 mm. The golf ball 2 having an amount of compressive deformation Sb of not greater than 4.5 mm has excellent flight performance upon a shot with a driver. In this respect, the amount of compressive deformation Sb is more preferably not greater than 4.0 mm and particularly preferably not greater than 3.8 mm.

For measurement of the amount of compressive deformation, a YAMADA type compression tester is used. In the tester, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s.

In the golf ball 2, the difference (Hc−Hm(min)) between the hardness Hc of the cover 8 and the hardness Hm(min) of the layer having the lowest hardness among the mid layers 6 is greater than 20. In other words, the golf ball 2 satisfies the following mathematical formula (2).

$$Hc-Hm(\min)>20 \quad (2)$$

When the golf ball 2 that satisfies the mathematical formula (2) is hit with a driver, the spin rate is low. The golf ball 2 has excellent flight performance upon a shot with a driver. In this respect, the difference (Hc−Hm(min)) is more preferably not less than 22 and particularly preferably not less than 24. In light of feel at impact upon putting, the difference (Hc−Hm(min)) is preferably not greater than 42, more preferably not greater than 40, and particularly preferably not greater than 38. In the golf ball 2, the difference (Hm(min)−Ho) between the hardness Hm(min) of the layer having the lowest hardness among the mid layers 6 and the central hardness Ho of the core 4 exceeds −10 and is less than 15. In other words, the golf ball 2 satisfies the following mathematical formula (3).

$$-10<Hm(\min)-Ho<15 \quad (3)$$

When the golf ball 2 in which the difference (Hm(min)−Ho) exceeds −10 is hit with a driver, the spin rate is low. The golf ball 2 has excellent flight performance upon a shot with a driver. In this respect, the difference (Hm(min)−Ho) is more preferably not less than −8 and particularly preferably not less than −6. The golf ball 2 in which the difference (Hm(min)−Ho) is less than 15 has excellent feel at impact upon putting. In this respect, the difference (Hm(min)−Ho) is more preferably not greater than 13 and particularly preferably not greater than 12.

In the golf ball 2, the difference (Hc−Hs) between the hardness Hc of the cover 8 and the surface hardness Hs of the core 4 exceeds 5 and is less than 20. In other words, the golf ball 2 satisfies the following mathematical formula (4).

$$5<Hc-Hs<20 \quad (4)$$

When the golf ball 2 in which the difference (Hc−Hs) exceeds 5 is hit with a driver, the spin rate is low. The golf ball 2 has excellent flight performance upon a shot with a driver. In this respect, the difference (Hc−Hs) is more preferably not less than 6 and particularly preferably not less than 7. When the golf ball 2 in which the difference (Hc−Hs) is less than 20 is hit with a driver, the spin rate is low. The golf ball 2 has excellent flight performance upon a shot with a driver. In this respect, the difference (Hc−Hs) is more preferably not greater than 19 and particularly preferably not greater than 18.

The hardness Hc of the cover 8 is higher than the hardness Hm(max) of the layer having the highest hardness among the mid layers 6. When the golf ball 2 in which the hardness Hc is higher than the hardness Hm(max) is hit with a driver, the spin rate is low. The golf ball 2 has excellent flight performance upon a shot with a driver. In this respect, the difference (Hc−Hm(max)) is preferably not less than 5, more preferably not less than 15, and particularly preferably not less than 20. In light of feel at impact upon putting, the difference (Hc−Hm(max)) is preferably not greater than 45, more preferably not greater than 40, and particularly preferably not greater than 38.

A total thickness TT of the mid layer 6 and the cover 8 is preferably not greater than 2.8 mm. The golf ball 2 in which the thickness TT is not greater than 2.8 mm has excellent feel at impact upon putting. In this respect, the thickness TT is more preferably not greater than 2.6 mm and particularly preferably not greater than 2.4 mm. In light of durability of golf ball 2, the thickness TT is preferably not less than 1.0 mm, more preferably not less than 1.4 mm, and particularly preferably not less than 1.6 mm. In the golf ball 2 including two or more mid layers 6, the thickness TT is the sum of the thickness of the cover 8 and the thicknesses of all the mid layers 6.

Figure 2:
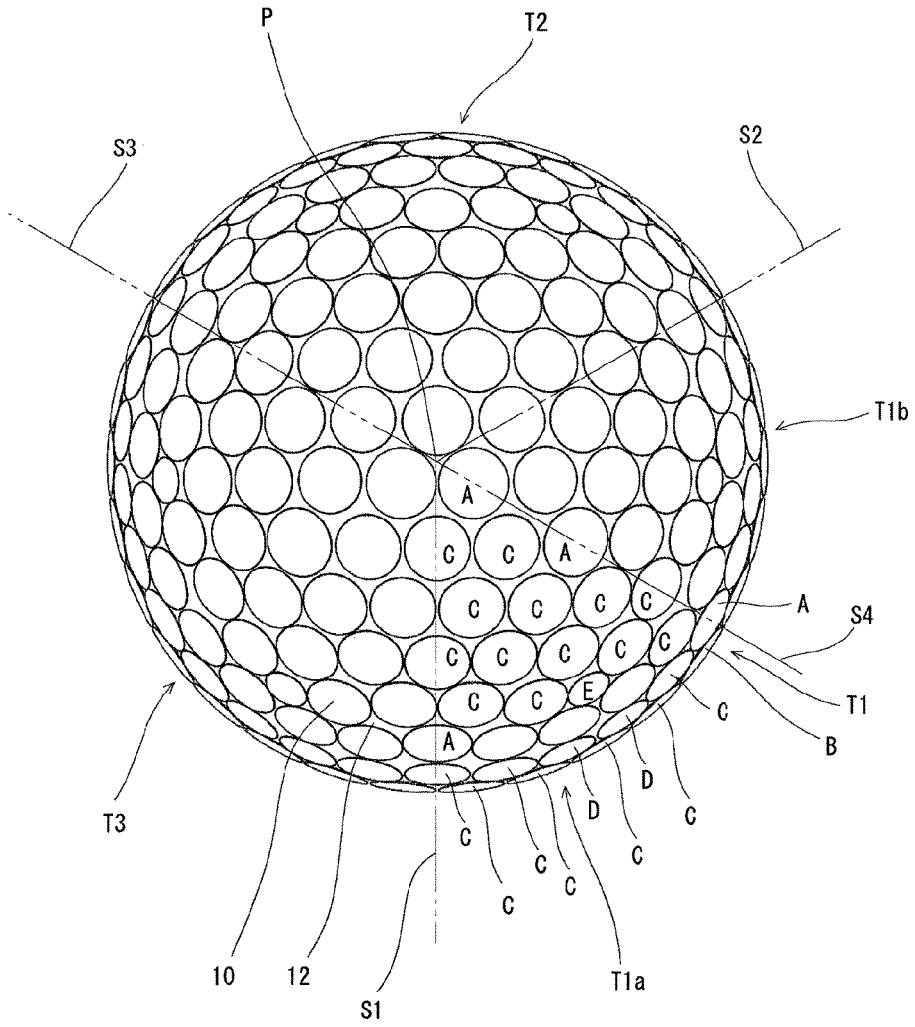
FIG. 2 is a plan view of the golf ball in FIG. 1.
Figure 3:
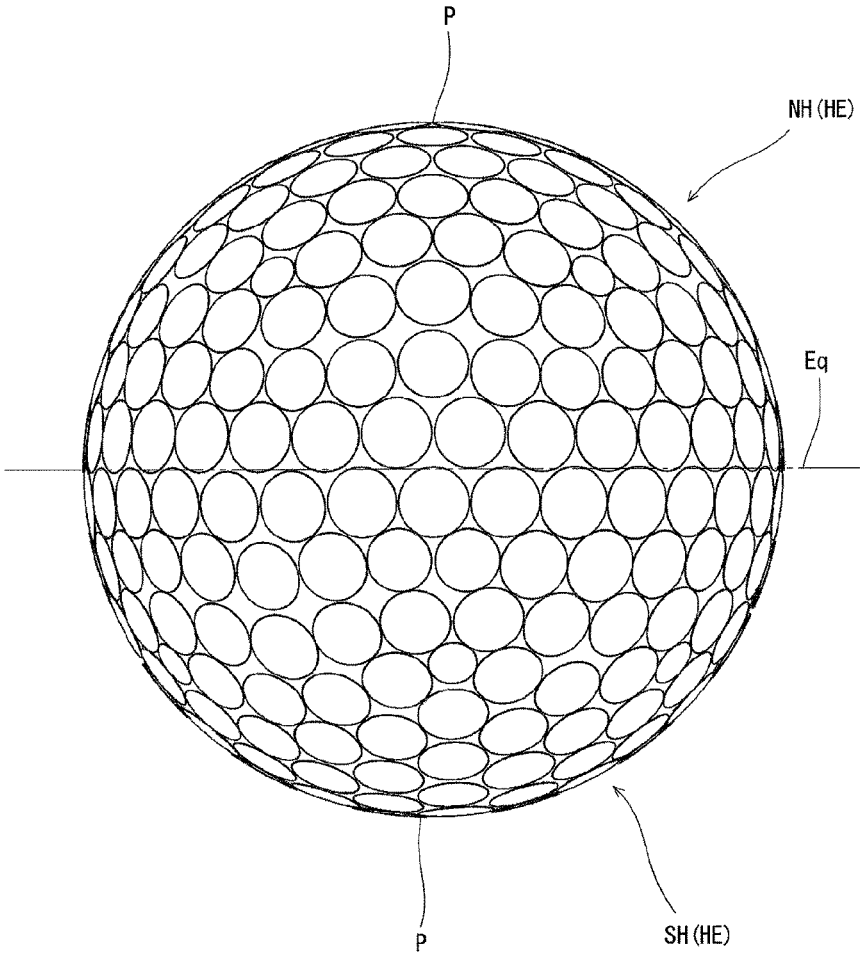
FIG. 3 is a front view of the golf ball in FIG. 2.

As shown in FIGS. 2 and 3, the contour of each dimple 10 is circular. The golf ball 2 has: dimples A each having a diameter of 4.60 mm; dimples B each having a diameter of 4.50 mm; dimples C each having a diameter of 4.35 mm; dimples D each having a diameter of 4.00 mm; and dimples E each having a diameter of 3.00 mm. The number of types of the dimples 10 is five. The golf ball 2 may have non-circular dimples instead of the circular dimples 10 or together with circular dimples 10.

The number of the dimples A is 24, the number of the dimples B is 12, the number of the dimples C is 252, the number of the dimples D is 24, and the number of the dimples E is 12. The total number of the dimples 10 is 324. A dimple pattern is formed by these dimples 10 and the land 12.

Figure 4:
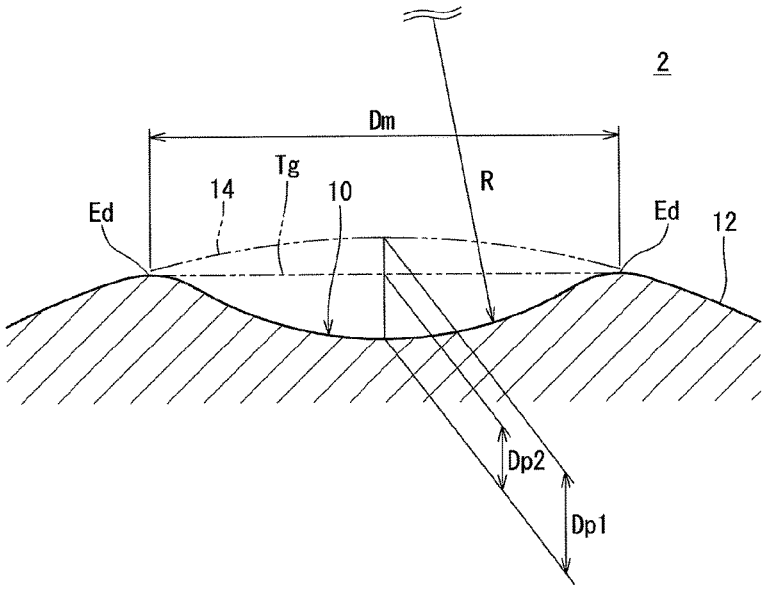
FIG. 4 is a partially enlarged cross-sectional view of the golf ball in FIG. 1.

FIG. 4 shows a cross section of the golf ball 2 along a plane passing through the central point of the dimple 10 and the central point of the golf ball 2. In FIG. 4, the top-to-bottom direction is the depth direction of the dimple 10. In FIG. 4, a chain double-dashed line 14 indicates a phantom sphere 14. The surface of the phantom sphere 14 is the surface of the golf ball 2 when it is postulated that no dimple 10 exists. The diameter of the phantom sphere 14 is equal to the diameter of the golf ball 2. The dimple 10 is recessed from the surface of the phantom sphere 14. The land 12 coincides with the surface of the phantom sphere 14. In the present embodiment, the cross-sectional shape of each dimple 10 is substantially a circular arc.

In FIG. 4, an arrow Dm indicates the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 4, a double ended arrow Dp1 indicates a first depth of the dimple 10. The first depth Dp1 is the distance between the deepest part of the dimple 10 and the surface of the phantom sphere 14. In FIG. 4, a double ended arrow Dp2 indicates a second depth of the dimple 10. The second depth Dp2 is the distance between the deepest part of the dimple 10 and the tangent line Tg.

The diameter Dm of each dimple 10 is preferably not less than 2.0 mm and not greater than 6.0 mm. The dimple 10 having a diameter Dm of not less than 2.0 mm contributes to turbulization upon a shot with a driver. In this respect, the diameter Dm is more preferably not less than 2.5 mm and particularly preferably not less than 2.8 mm. The dimple 10 having a diameter Dm of not greater than 6.0 mm does not impair a fundamental feature of the golf ball 2 being substantially a sphere. In this respect, the diameter Dm is more preferably not greater than 5.5 mm and particularly preferably not greater than 5.0 mm.

In the case of a non-circular dimple, a circular dimple 10 having the same area as that of the non-circular dimple is assumed. The diameter of the assumed dimple 10 can be regarded as the diameter of the non-circular dimple.

The ratio Pd of the diameter Dm of each dimple 10 relative to the diameter of the golf ball 2 is preferably not less than 9.60% and not greater than 10.37%. The dimple 10 having a ratio Pd of not less than 9.60% contributes to turbulization upon a shot with a driver. In this respect, the ratio Pd is more preferably not less than 9.90% and particularly preferably not less than 10.10%. The dimple 10 having a ratio Pd of not greater than 10.37% does not impair a fundamental feature of the golf ball 2 being substantially a sphere. In this respect, the ratio Pd is more preferably not greater than 10.32% and particularly preferably not greater than 10.27%.

The ratio Rs of the number of the dimples 10 each having a ratio Pd of not less than 9.60% and not greater than 10.37%, relative to the total number of the dimples 10, is preferably not less than 50%. The dimple pattern having a ratio Rs of not less than 50% contributes to turbulization upon a shot with a driver. In this respect, the ratio Rs is more preferably not less than 60% and particularly preferably not less than 70%. The ratio Rs may be 100%.

The ratio Rs' of the number of the dimples 10 each having a ratio Pd of not less than 10.10% and not greater than 10.37%, relative to the total number of the dimples 10, is preferably not less than 50%. The dimple pattern having a ratio Rs' of not less than 50% contributes to turbulization upon a shot with a driver. In this respect, the ratio Rs' is more preferably not less than 60% and particularly preferably not less than 70%. The ratio Rs' may be 100%.

The ratio of the number of the dimples 10 each having a ratio Pd exceeding 10.37%, relative to the total number of the dimples 10, is preferably less than 50%. With the dimple pattern in which this ratio is less than 50%, the degree of freedom in designing a dimple pattern is high, and therefore the width of the land 12 is less likely to be excessively large. In this respect, this ratio is more preferably not greater than 30% and particularly preferably not greater than 10%. This ratio may be zero.

In light of suppression of rising of the golf ball 2 during flight, the first depth Dp1 of each dimple 10 is preferably not less than 0.10 mm, more preferably not less than 0.13 mm, and particularly preferably not less than 0.15 mm. In light of suppression of dropping of the golf ball 2 during flight, the first depth Dp1 is preferably not greater than 0.65 mm, more preferably not greater than 0.60 mm, and particularly preferably not greater than 0.55 mm.

The area S of the dimple 10 is the area of a region surrounded by the contour line of the dimple 10 when the central point of the golf ball 2 is viewed at infinity. In the case of a circular dimple 10, the area S is calculated by the following mathematical formula.

$$S=(Dm/2)^2*\pi$$

In the golf ball 2 shown in FIGS. 2 and 3, the area of each dimple A is 16.62 $mm^2$, the area of each dimple B is 15.90 $mm^2$, the area of each dimple C is 14.86 $mm^2$, the area of each dimple D is 12.57 $mm^2$, and the area of each dimple E is 7.07 $mm^2$.

In the present invention, the ratio of the sum of the areas S of all the dimples 10 relative to the surface area of the phantom sphere 14 is referred to as an occupation ratio So. From the standpoint that sufficient turbulization is achieved, the occupation ratio So is preferably not less than 81.0% and more preferably not less than 82.0%. The occupation ratio So is preferably not greater than 95%. In the golf ball 2 shown in FIGS. 2 and 3, the total area of the dimples 10 is 4721.1 $mm^2$. The surface area of the phantom sphere 14 of the golf ball 2 is 5728.0 $mm^2$, so that the occupation ratio So is 82.4%.

From the standpoint that a sufficient occupation ratio is achieved, the total number N of the dimples 10 is preferably not less than 250, more preferably not less than 280, and particularly preferably not less than 300. From the standpoint that each dimple 10 can contribute to turbulization, the total number N of the dimples 10 is preferably not greater than 450, more preferably not greater than 400, and particularly preferably not greater than 380.

In the present invention, the "volume of the dimple" means the volume of a portion surrounded by the surface of the phantom sphere 14 and the surface of the dimple 10. In light of suppression of rising of the golf ball 2 during flight, the total volume of all the dimples 10 is preferably not less than 450 $mm^3$, more preferably not less than 480 $mm^3$, and particularly preferably not less than 500 $mm^3$. In light of suppression of dropping of the golf ball 2 during flight, the total volume is preferably not greater than 750 $mm^3$, more preferably not greater than 730 $mm^3$, and particularly preferably not greater than 710 $mm^3$.

Figure 5:
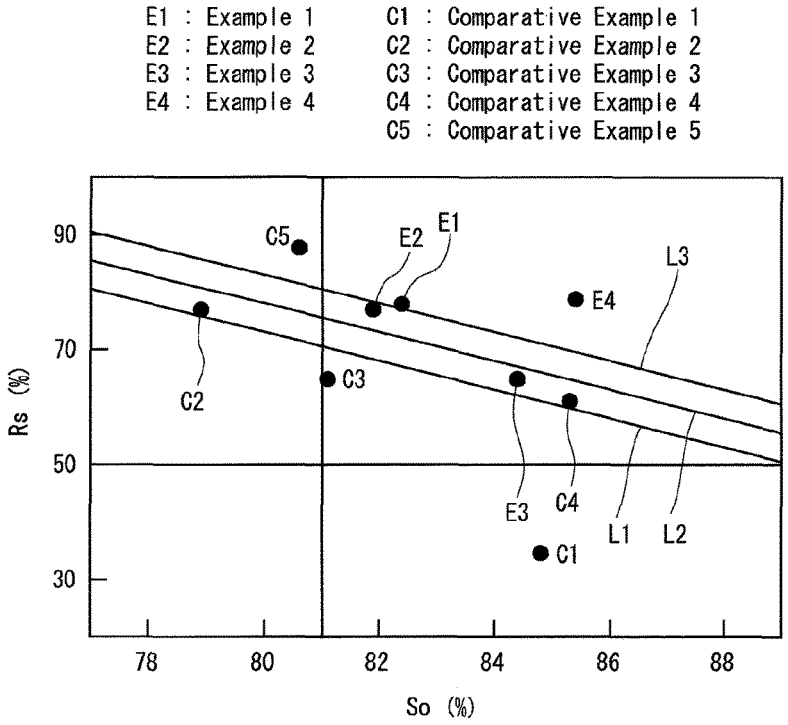
FIG. 5 is a graph showing a relationship between a ratio So and a ratio Rs.

In a graph shown in FIG. 5, the horizontal axis indicates the occupation ratio So of the dimples 10. In this graph, the vertical axis indicates the ratio Rs of the number of the dimples 10 each having a ratio Pd of not less than 9.60% and not greater than 10.37%, relative to the total number of the dimples 10. A straight line indicated by reference sign L1 in this graph is represented by the following mathematical formula.

$$Rs=-2.5*So+273$$

The golf ball 2 that is plotted in the zone above the straight line L1 in this graph satisfies the following mathematical formula (5).

$$Rs\geq-2.5*So+273 \quad (5)$$

With the golf ball 2 that satisfies the mathematical formula (5), turbulization is promoted. The golf ball 2 has excellent flight performance upon a shot with a driver.

A straight line indicated by reference sign L2 in the graph of FIG. 5 is represented by the following mathematical formula.

$$Rs=-2.5*So+278$$

The golf ball 2 that is plotted in the zone above the straight line L2 in this graph satisfies the following mathematical formula (6).

$$Rs\geq-2.5*So+278 \quad (6)$$

With the golf ball 2 that satisfies the mathematical formula (6), turbulization is promoted. The golf ball 2 has excellent flight performance upon a shot with a driver.

A straight line indicated by reference sign L3 in the graph of FIG. 5 is represented by the following mathematical formula.

$$Rs=-2.5*So+283$$

The golf ball 2 that is plotted in the zone above the straight line L3 in this graph satisfies the following mathematical formula (7).

$$Rs\geq-2.5*So+283 \quad (7)$$

With the golf ball 2 that satisfies the mathematical formula (7), turbulization is promoted. The golf ball 2 has excellent flight performance upon a shot with a driver.

Figure 6:
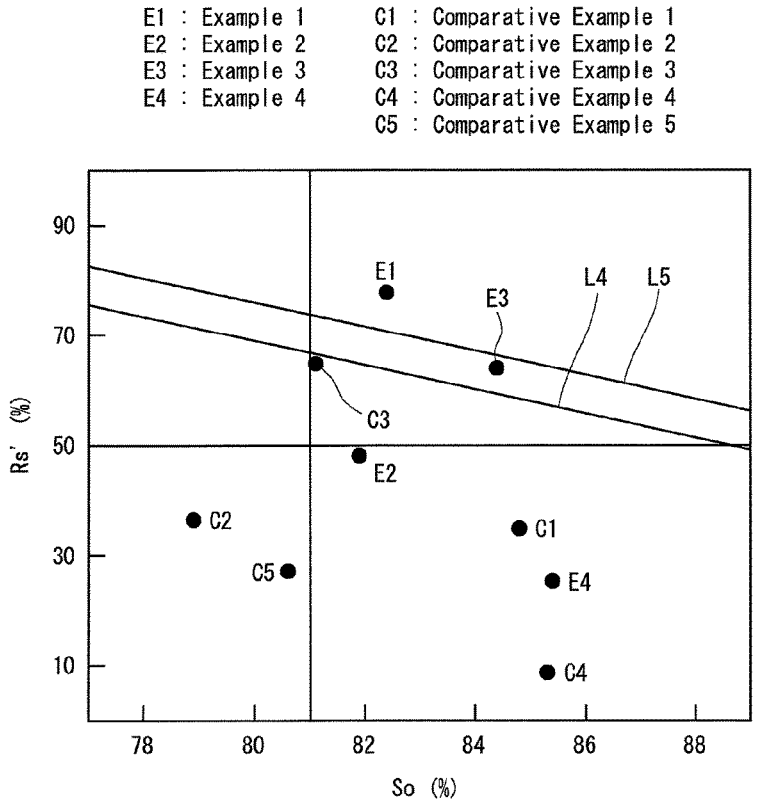
FIG. 6 is a graph showing a relationship between the ratio So and a ratio Rs'.

In a graph shown in FIG. 6, the horizontal axis indicates the occupation ratio So of the dimples 10. In this graph, the vertical axis indicates the ratio Rs' of the number of the dimples 10 each having a ratio Pd of not less than 10.10% and not greater than 10.37%, relative to the total number of the dimples 10. A straight line indicated by reference sign L4 in this graph is represented by the following mathematical formula.

$$Rs'=-2.2*So+245$$

The golf ball 2 that is plotted in the zone above the straight line L4 in this graph satisfies the following mathematical formula (8).

$$Rs'\geq-2.2*So+245 \quad (8)$$

With the golf ball 2 that satisfies the mathematical formula (8), turbulization is promoted. The golf ball 2 has excellent flight performance upon a shot with a driver.

A straight line indicated by reference sign L5 in the graph of FIG. 6 is represented by the following mathematical formula.

$$Rs'=-2.2*So+252$$

The golf ball 2 that is plotted in the zone above the straight line L5 in this graph satisfies the following mathematical formula (9).

$$Rs'\geq-2.2*So+252 \quad (9)$$

With the golf ball 2 that satisfies the mathematical formula (9), turbulization is promoted. The golf ball 2 has excellent flight performance upon a shot with a driver.

As shown in FIG. 3, the surface of the golf ball 2 (or the phantom sphere 14) can be divided into two hemispheres HE by an equator Eq. Specifically, the surface can be divided into a northern hemisphere NH and a southern hemisphere SH. Each hemisphere HE has a pole P. The pole P corresponds to a deepest point of a mold for the golf ball 2.

FIG. 2 shows the northern hemisphere. The southern hemisphere has a pattern obtained by rotating the dimple pattern in FIG. 2 about the pole P. Line segments S1, S2, and S3 shown in FIG. 2 each extend from the pole P. The angle at the pole P between the line segment S1 and the line segment S2 is 120°. The angle at the pole P between the line segment S2 and the line segment S3 is 120°. The angle at the pole P between the line segment S3 and the line segment S1 is 120°.

Of the surface of the golf ball 2 (or the phantom sphere 14), a zone surrounded by the line segment S1, the line segment S2, and the equator Eq is a first spherical triangle T1. Of the surface of the golf ball 2 (or the phantom sphere 14), a zone surrounded by the line segment S2, the line segment S3, and the equator Eq is a second spherical triangle T2. Of the surface of the golf ball 2 (or the phantom sphere 14), a zone surrounded by the line segment S3, the line segment S1, and the equator Eq is a third spherical triangle T3. Each spherical triangle is a unit. The hemisphere HE can be divided into the three units.

When the dimple pattern of the first spherical triangle T1 is rotated by 120° about a straight line connecting the two poles P, the resultant dimple pattern substantially overlaps the dimple pattern of the second spherical triangle T2. When the dimple pattern of the second spherical triangle T2 is rotated by 120° about the straight line connecting the two poles P, the resultant dimple pattern substantially overlaps the dimple pattern of the third spherical triangle T3. When the dimple pattern of the third spherical triangle T3 is rotated by 120° about the straight line connecting the two poles P, the resultant dimple pattern substantially overlaps the dimple pattern of the first spherical triangle T1. In other words, the dimple pattern of the hemisphere is composed of three units that are rotationally symmetrical to each other.

A pattern obtained by rotating the dimple pattern of each hemisphere HE by 120° about the straight line connecting the two poles P substantially overlaps the dimple pattern that has not been rotated. The dimple pattern of each hemisphere HE has 120° rotational symmetry.

A line segment S4 shown in FIG. 2 extends from the pole P. The angle at the pole P between the line segment S4 and the line segment S1 is 60°. The angle at the pole P between the line segment S4 and the line segment S2 is 60°. The first spherical triangle T1 (unit) can be divided into a small spherical triangle T1*a* and another small spherical triangle T1*b* by the line segment S4. The spherical triangle T1*a* and the spherical triangle T1*b* are small units.

A pattern obtained by inverting the dimple pattern of the spherical triangle T1*a* with respect to a plane containing the line segment S4 and the straight line connecting both poles P substantially overlaps the dimple pattern of the spherical triangle T1*b*. In other words, the dimple pattern of each unit is composed of two small units that are mirror-symmetrical to each other.

Similarly, the dimple pattern of the second spherical triangle T2 is also composed of two small units that are mirror-symmetrical to each other. The dimple pattern of the third spherical triangle T3 is also composed of two small units that are mirror-symmetrical to each other. The dimple pattern of the hemisphere HE is composed of the six small units.

According to the finding by the present inventor, with the golf ball 2 of which the dimple pattern of each hemisphere is composed of three units that are rotationally symmetrical to each other by 120° and the dimple pattern of each unit is composed of two small units that are mirror-symmetrical to each other, turbulization is promoted. The golf ball 2 has excellent flight performance upon a shot with a driver.

EXAMPLES

Example 1

A rubber composition I was obtained by kneading 100 parts by weight of a high-cis polybutadiene (trade name "BR-730", manufactured by JSR Corporation), 25.5 parts by weight of zinc diacrylate, 12 parts by weight of zinc oxide, an appropriate amount of barium sulfate, 0.5 parts by weight of diphenyl disulfide, 0.9 parts by weight of dicumyl peroxide, 0.1 parts by weight of 2-naphthalenethiol, and 2 parts by weight of benzoic acid. This rubber composition I was placed into a mold including upper and lower mold halves each having a hemispherical cavity, and heated at 160° C. for 20 minutes to obtain a core with a diameter of 38.6 mm. The amount of barium sulfate was adjusted such that a core having a predetermined weight was obtained.

A resin composition (a) was obtained by kneading 26 parts by weight of an ionomer resin (the aforementioned "Himilan AM7337"), 26 parts by weight of another ionomer resin (the aforementioned "Himilan AM7329"), 48 parts by weight of a styrene block-containing thermoplastic elastomer (the aforementioned "RABALON T3221C"), 4 parts by weight of titanium dioxide, and 0.2 parts by weight of a light stabilizer (trade name "JF-90", manufactured by Johoku Chemical Co., Ltd.) with a twin-screw kneading extruder. The core was covered with the resin composition (a) by injection molding to form a mid layer with a thickness of 1.0 mm.

A resin composition (e) was obtained by kneading 55 parts by weight of an ionomer resin (the aforementioned "Himilan AM7329"), 45 parts by weight of another ionomer resin (the aforementioned "Himilan 1555"), 4 parts by weight of titanium dioxide, and 0.2 parts by weight of a light stabilizer (trade name "JF-90", manufactured by Johoku Chemical Co., Ltd.) with a twin-screw kneading extruder. The sphere consisting of the core and the mid layer was placed into a final mold that includes upper and lower mold halves each having a hemispherical cavity and having a large number of pimples on its cavity face. The mid layer was covered with the resin composition (e) by injection molding to form a cover with a thickness of 1.05 mm. Dimples having a shape that is the inverted shape of the pimples were formed on the cover.

A clear paint including a two-component curing type polyurethane as a base material was applied to this cover to obtain a golf ball of Example 1 with a diameter of about 42.7 mm and a weight of about 45.6 g. Dimple specifications D1 of the golf ball are shown in detail in Tables 4 and 6 below.

Examples 2 to 4 and Comparative Examples 1 to 3

Golf balls of Examples 2 to 4 and Comparative Examples 1 to 3 were obtained in the same manner as Example 1, except the specifications of the dimples were as shown in Tables 8 and 9 below. The specifications of the dimples are shown in detail in Tables 4 to 7 below. In each golf ball, the dimple pattern of each hemisphere is composed of three units that are rotationally symmetrical to each other. The dimple pattern of each unit is composed of two small units that are mirror-symmetrical to each other. The number of the small units in each hemisphere is six.

Comparative Examples 4 and 5

Golf balls of Comparative Examples 4 and 5 were obtained in the same manner as Example 1, except the specifications of the dimples were as shown in Table 9 below. The specifications of the dimples are shown in detail in Tables 5 and 7 below. The dimple pattern of the golf ball according to Comparative Example 4 is the same as the dimple pattern of the golf ball according to Example 1 in JP2013-153966. The dimple pattern of each hemisphere of the golf ball according to Comparative Example 4 does not have rotational symmetry. The dimple pattern of the golf ball according to Comparative Example 5 is the same as the dimple pattern of the golf ball according to Comparative Example 1 in JP2013-153966. The dimple pattern of each hemisphere of the golf ball according to Comparative Example 5 does not have rotational symmetry.

Examples 5 to 8 and Comparative Examples 6 to 12

Golf balls of Examples 5 to 8 and Comparative Examples 6 to 12 were obtained in the same manner as Example 1, except the specifications of the core, the mid layer, and the cover were as shown in Tables 10 to 12 below. The specifications of the core are shown in detail in Tables 1 and 2 below. The specifications of the mid layer and the cover are shown in detail in Table 3 below.

Example 9

A rubber composition II was obtained by kneading 100 parts by weight of a high-cis polybutadiene (trade name "BR-730", manufactured by JSR Corporation), 22.5 parts by weight of zinc diacrylate, 12 parts by weight of zinc oxide, an appropriate amount of barium sulfate, 0.5 parts by weight of diphenyl disulfide, 0.9 parts by weight of dicumyl peroxide, 0.1 parts by weight of 2-naphthalenethiol, and 2 parts by weight of benzoic acid. This rubber composition II was placed into a mold including upper and lower mold halves each having a hemispherical cavity, and heated at 160° C. for 20 minutes to obtain a core with a diameter of 36.6 mm. The amount of barium sulfate was adjusted such that a core having a predetermined weight was obtained.

A resin composition (a) was obtained by kneading 26 parts by weight of an ionomer resin (the aforementioned "Himilan AM7337"), 26 parts by weight of another ionomer resin (the aforementioned "Himilan AM7329"), 48 parts by weight of a styrene block-containing thermoplastic elastomer (the aforementioned "RABALON T3221C"), 4 parts by weight of titanium dioxide, and 0.2 parts by weight of a light stabilizer (trade name "JF-90", manufactured by Johoku Chemical Co., Ltd.) with a twin-screw kneading extruder. The core was covered with the resin composition (a) by injection molding to form a first mid layer with a thickness of 1.0 mm.

A resin composition (c) was obtained by kneading 43 parts by weight of an ionomer resin (the aforementioned "Himilan AM7337"), 40 parts by weight of another ionomer resin (the aforementioned "Himilan AM7329"), 17 parts by weight of a styrene block-containing thermoplastic elastomer (the aforementioned "RABALON T3221C"), 4 parts by weight of titanium dioxide, and 0.2 parts by weight of a light stabilizer (trade name "JF-90", manufactured by Johoku Chemical Co., Ltd.) with a Lwin-screw kneading extruder. The first mid layer was covered with the resin composition (c) by injection molding to form a second mid layer with a thickness of 1.0 mm.

A resin composition (e) was obtained by kneading 55 parts by weight of an ionomer resin (the aforementioned "Himilan AM7329"), 45 parts by weight of another ionomer resin (the aforementioned "Himilan 1555"), 4 parts by weight of titanium dioxide, and 0.2 parts by weight of a light stabilizer (trade name "JF-90", manufactured by Johoku Chemical Co., Ltd.) with a twin-screw kneading extruder. The sphere consisting of the core, the first mid layer, and the second mid layer was placed into a final mold that includes upper and lower mold halves each having a hemispherical cavity and having a large number of pimples on its cavity face. The second mid layer was covered with the resin composition (e) by injection molding to form a cover with a thickness of 1.05 mm. Dimples having a shape that is the inverted shape of the pimples were formed on the cover.

A clear paint including a two-component curing type polyurethane as a base material was applied to this cover to obtain a golf ball of Example 9 with a diameter of about 42.7 mm and a weight of about 45.6 g. Dimple specifications D1 of the golf ball are shown in detail in Tables 4 and 6 below.

[Flight Test]

A driver (trade name "XXIO9", manufactured by DUNLOP SPORTS CO. LTD., shaft hardness: R, loft angle: 10.5°) was attached to a swing machine manufactured by Golf Laboratories, Inc. A golf ball was hit under a condition of a head speed of 40 m/sec. The ball speed and the spin rate were measured immediately after the hit. Furthermore, the flight distance was measured. The flight distance is the distance between the point at the hit and the point at which the ball stopped. The average value of data obtained from 12 measurements is shown in Tables 8 to 11 below.

[Feel at Impact]

Twenty golf players hit golf balls with putters and were asked about feel at impact. The evaluation was categorized as follows on the basis of the number of golf players who answered, "the feel at impact was soft".

A: 16 persons or more

B: 10 to 15 persons

C: 3 to 9 persons

D: 2 persons or less

The results are shown in Tables 8 to 12 below.

TABLE 1

Specifications of Core (parts by weight)

| | I | II | III | IV |
|---|---|---|---|---|
| Polybutadiene | 100 | 100 | 100 | 100 |
| Zinc diacrylate | 25.5 | 22.5 | 28.5 | 35.5 |
| Zinc oxide | 12 | 12 | 12 | 12 |
| Barium sulfate | Appropriate amount | Appropriate amount | Appropriate amount | Appropriate amount |
| Diphenyl disulfide | 0.5 | 0.5 | 0.5 | 0.5 |
| Dicumyl peroxide | 0.9 | 0.9 | 0.9 | 0.9 |
| 2-naphthalenethiol | 0.1 | 0.1 | 0.1 | 0.1 |
| Benzoic acid | 2 | 2 | 2 | 2 |
| Crosslinking temperature (° C.) | 160 | 160 | 160 | 160 |
| Crosslinking time period (min) | 20 | 20 | 20 | 20 |

TABLE 2

Specifications of Core (parts by weight)

| | V | VI | VII |
|---|---|---|---|
| Polybutadiene | 100 | 100 | 100 |
| Zinc diacrylate | 26.0 | 25.0 | 31.5 |
| Zinc oxide | 12 | 5 | 5 |
| Barium sulfate | Appropriate amount | Appropriate amount | Appropriate amount |
| Diphenyl disulfide | 0.5 | 0.5 | 0.5 |
| Dicumyl peroxide | 0.9 | 0.9 | 0.9 |
| 2-naphthalenethiol | 0.1 | — | 0.1 |
| Benzoic acid | 2 | — | — |
| Crosslinking temperature (° C.) | 160 | 140 | 160 |
| Crosslinking time period (min) | 20 | 20 | 20 |

TABLE 3

Specifications of Mid Layer and Cover

| | (a) | (b) | (c) | (d) | (e) | (f) | (g) |
|---|---|---|---|---|---|---|---|
| | | | | | | (parts by weight) | |
| Himilan AM7337 | 26 | 25 | 43 | 26 | — | — | 50 |

TABLE 3-continued

Specifications of Mid Layer and Cover

| | (a) | (b) | (c) | (d) | (e) | (f) | (g) |
|---|---|---|---|---|---|---|---|
| | | | | | | (parts by weight) | |
| Himilan AM7329 | 26 | 25 | 40 | 40 | 55 | 46 | 50 |
| Himilan 1555 | — | — | — | — | 45 | 47 | — |
| RABALON T3221C | 48 | 50 | 17 | 34 | — | 7 | — |
| Titanium dioxide | 4 | 4 | 4 | 4 | 4 | 4 | 4 |
| JF-90 | 0.2 | 0.2 | 0.2 | 0.2 | 0.2 | 0.2 | 0.2 |
| Hardness (Shore C) | 57 | 54 | 83 | 70 | 92 | 87 | 97 |

TABLE 4

Specifications of Dimples

| | | Num. | Dia. (mm) | Dp2 (mm) | Dp1 (mm) | R (mm) | Volume ($mm^3$) | Pd (%) |
|---|---|---|---|---|---|---|---|---|
| D1 | A | 24 | 4.60 | 0.135 | 0.2592 | 19.66 | 1.123 | 10.77 |
| | B | 12 | 4.50 | 0.135 | 0.2539 | 18.82 | 1.075 | 10.54 |
| | C | 252 | 4.35 | 0.135 | 0.2461 | 17.59 | 1.004 | 10.19 |
| | D | 24 | 4.00 | 0.135 | 0.2289 | 14.88 | 0.850 | 9.37 |
| | E | 12 | 3.00 | 0.135 | 0.1878 | 8.40 | 0.478 | 7.03 |
| D2 | A | 30 | 4.70 | 0.135 | 0.2647 | 20.52 | 1.172 | 11.01 |
| | B | 30 | 4.60 | 0.135 | 0.2592 | 19.66 | 1.123 | 10.77 |
| | C | 150 | 4.40 | 0.135 | 0.2487 | 17.99 | 1.028 | 10.30 |
| | D | 90 | 4.30 | 0.135 | 0.2435 | 17.19 | 0.982 | 10.07 |
| | E | 12 | 3.00 | 0.135 | 0.1878 | 8.40 | 0.478 | 7.03 |
| D3 | A | 24 | 4.60 | 0.135 | 0.2592 | 19.66 | 1.123 | 10.77 |
| | B | 54 | 4.50 | 0.135 | 0.2539 | 18.82 | 1.075 | 10.54 |
| | C | 210 | 4.40 | 0.135 | 0.2487 | 17.99 | 1.028 | 10.30 |
| | D | 24 | 4.00 | 0.135 | 0.2289 | 14.88 | 0.850 | 9.37 |
| | E | 12 | 3.00 | 0.135 | 0.1878 | 8.40 | 0.478 | 7.03 |
| D4 | A | 12 | 4.60 | 0.135 | 0.2592 | 19.66 | 1.123 | 10.77 |
| | B | 48 | 4.50 | 0.135 | 0.2539 | 18.82 | 1.075 | 10.54 |
| | C | 86 | 4.40 | 0.135 | 0.2487 | 17.99 | 1.028 | 10.30 |
| | D | 60 | 4.30 | 0.135 | 0.2435 | 17.19 | 0.982 | 10.07 |
| | E | 120 | 4.20 | 0.135 | 0.2385 | 16.40 | 0.936 | 9.84 |
| | F | 12 | 3.05 | 0.135 | 0.1895 | 8.68 | 0.494 | 7.14 |

TABLE 5

Specifications of Dimples

| | | Num. | Dia. (mm) | Dp2 (mm) | Dp1 (mm) | R (mm) | Volume ($mm^3$) | Pd (%) |
|---|---|---|---|---|---|---|---|---|
| D5 | A | 108 | 4.60 | 0.135 | 0.2592 | 19.66 | 1.123 | 10.77 |
| | B | 84 | 4.50 | 0.135 | 0.2539 | 18.82 | 1.075 | 10.54 |
| | C | 108 | 4.40 | 0.135 | 0.2487 | 17.99 | 1.028 | 10.30 |
| | D | 12 | 3.00 | 0.135 | 0.1878 | 8.40 | 0.478 | 7.03 |
| D6 | A | 30 | 4.70 | 0.135 | 0.2647 | 20.52 | 1.172 | 11.01 |
| | B | 18 | 4.65 | 0.135 | 0.2620 | 20.09 | 1.148 | 10.89 |
| | C | 48 | 4.40 | 0.135 | 0.2487 | 17.99 | 1.028 | 10.30 |
| | D | 66 | 4.35 | 0.135 | 0.2461 | 17.59 | 1.004 | 10.19 |
| | E | 126 | 4.20 | 1.135 | 1.2385 | 2.51 | 8.628 | 9.84 |
| | F | 12 | 4.00 | 2.135 | 2.2289 | 2.00 | 18.510 | 9.37 |
| | G | 12 | 3.00 | 3.135 | 3.1878 | 1.93 | 27.213 | 7.03 |
| D7 | A | 24 | 4.60 | 0.135 | 0.2592 | 19.66 | 1.123 | 10.77 |
| | B | 12 | 4.50 | 0.135 | 0.2539 | 18.82 | 1.075 | 10.54 |
| | C | 210 | 4.35 | 0.135 | 0.2461 | 17.59 | 1.004 | 10.19 |
| | D | 66 | 4.05 | 0.135 | 0.2313 | 15.26 | 0.871 | 9.48 |
| | E | 12 | 3.00 | 0.135 | 0.1878 | 8.40 | 0.478 | 7.03 |
| D8 | A | 16 | 4.60 | 0.135 | 0.2592 | 19.66 | 1.123 | 10.77 |
| | B | 30 | 4.50 | 0.135 | 0.2539 | 18.82 | 1.075 | 10.54 |
| | C | 30 | 4.40 | 0.135 | 0.2487 | 17.99 | 1.028 | 10.30 |
| | D | 150 | 4.30 | 0.135 | 0.2435 | 17.19 | 0.982 | 10.07 |
| | E | 30 | 4.20 | 0.135 | 0.2385 | 16.40 | 0.936 | 9.84 |
| | F | 66 | 4.10 | 0.135 | 0.2336 | 15.63 | 0.892 | 9.60 |

TABLE 5-continued

| Specifications of Dimples | | | | | | | | |
|---|---|---|---|---|---|---|---|---|
| | | Num. | Dia. (mm) | Dp2 (mm) | Dp1 (mm) | R (mm) | Volume ($mm^3$) | Pd (%) |
| | G | 10 | 3.80 | 0.135 | 0.2197 | 13.44 | 0.767 | 8.90 |
| | H | 12 | 3.40 | 0.135 | 0.2028 | 10.77 | 0.614 | 7.96 |
| D9 | A | 26 | 4.50 | 0.135 | 0.2539 | 18.82 | 1.075 | 10.54 |
| | B | 88 | 4.40 | 0.135 | 0.2487 | 17.99 | 1.028 | 10.30 |
| | C | 102 | 4.30 | 0.135 | 0.2435 | 17.19 | 0.982 | 10.07 |
| | D | 94 | 4.10 | 0.135 | 0.2336 | 15.63 | 0.892 | 9.60 |
| | E | 14 | 3.60 | 0.135 | 0.2110 | 12.07 | 0.688 | 8.43 |

TABLE 6

Figure 7:
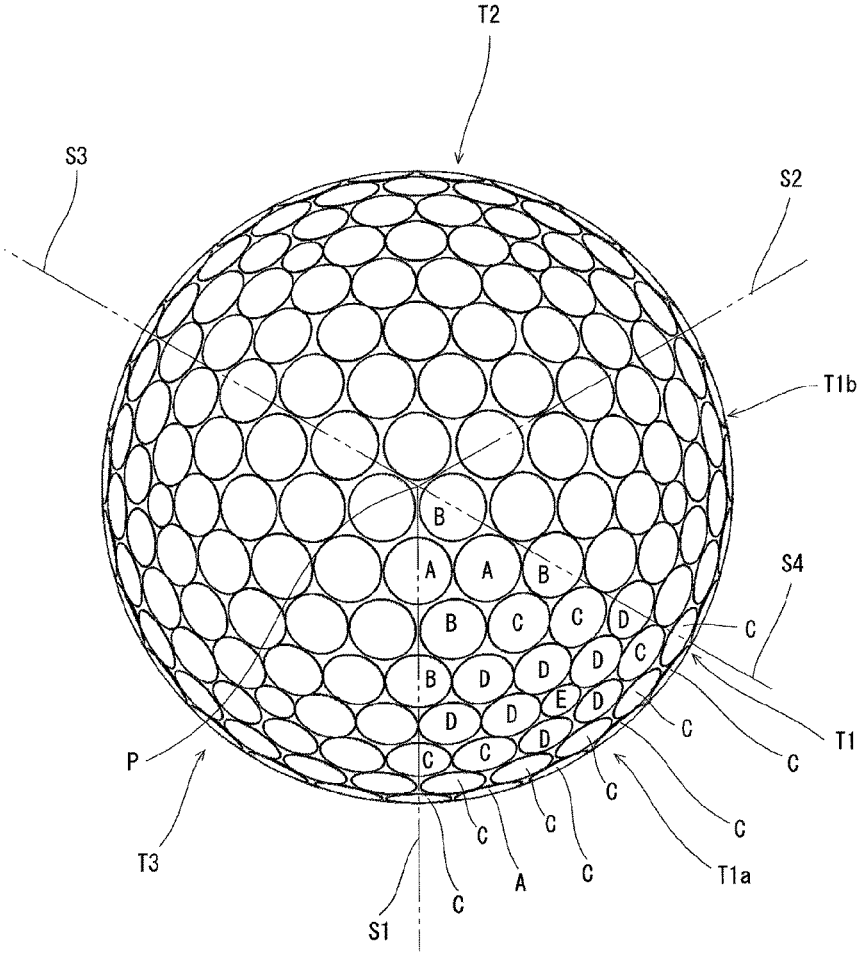
FIG. 7 is a plan view of a golf ball according to Example 2 of the present invention.
Figure 8:
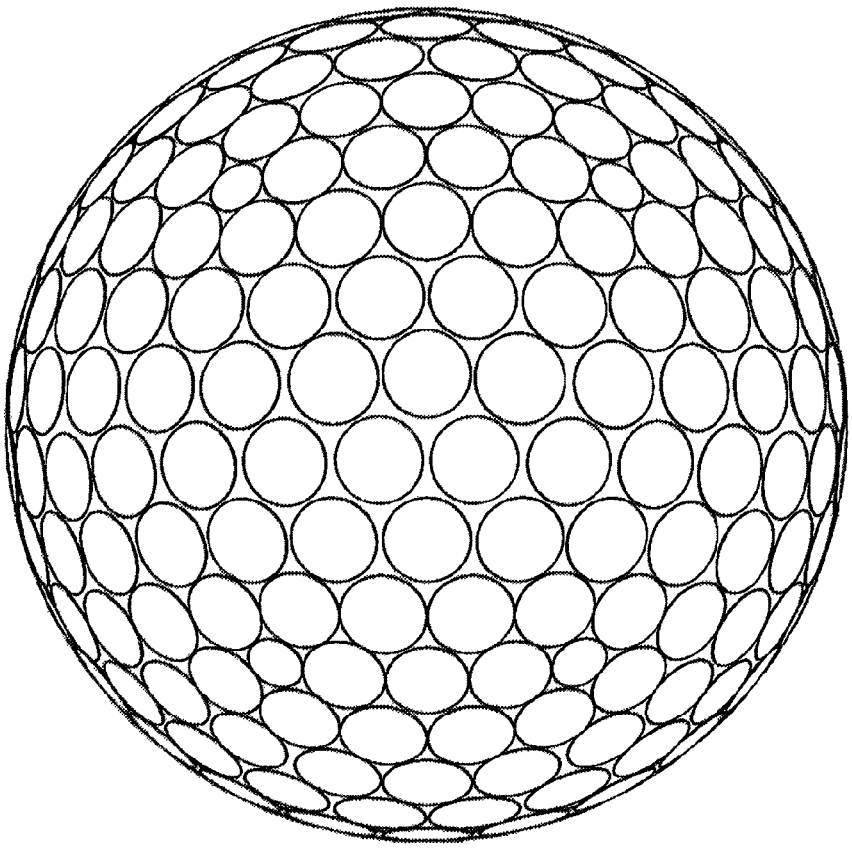
FIG. 8 is a front view of the golf ball in FIG. 7.
Figure 9:
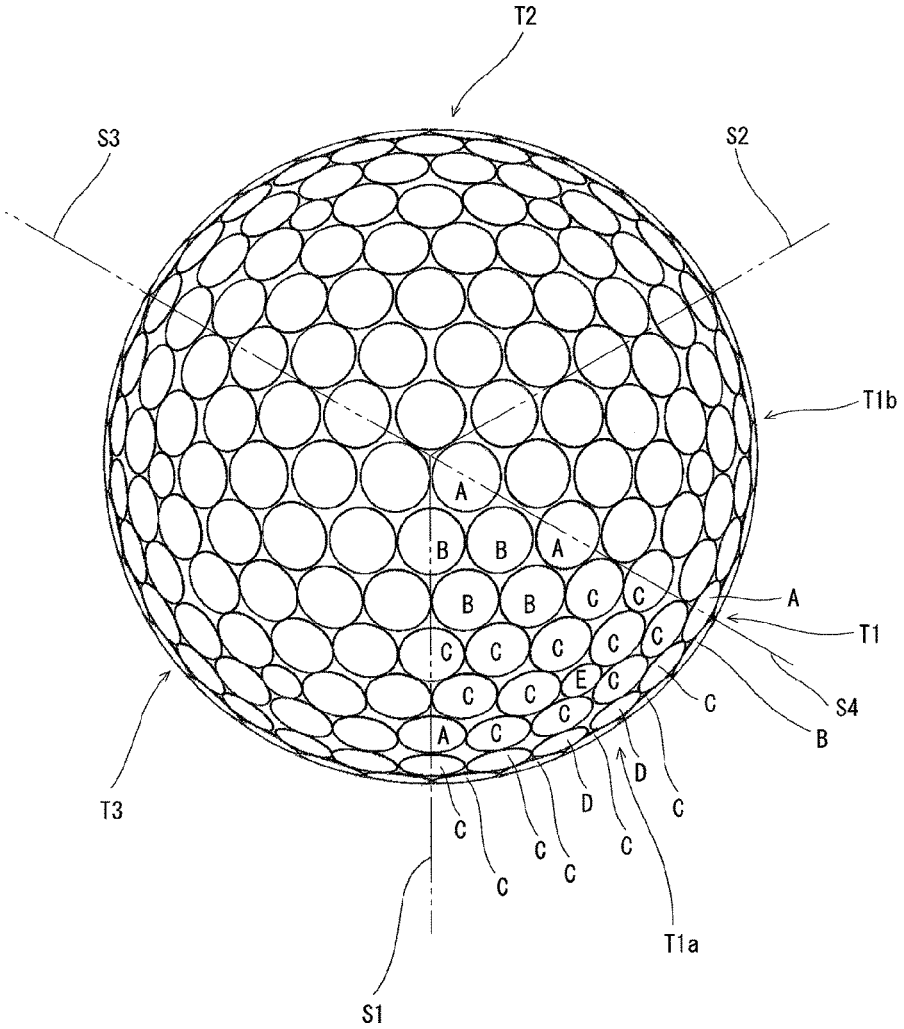
FIG. 9 is a plan view of a golf ball according to Example 3 of the present invention.
Figure 10:
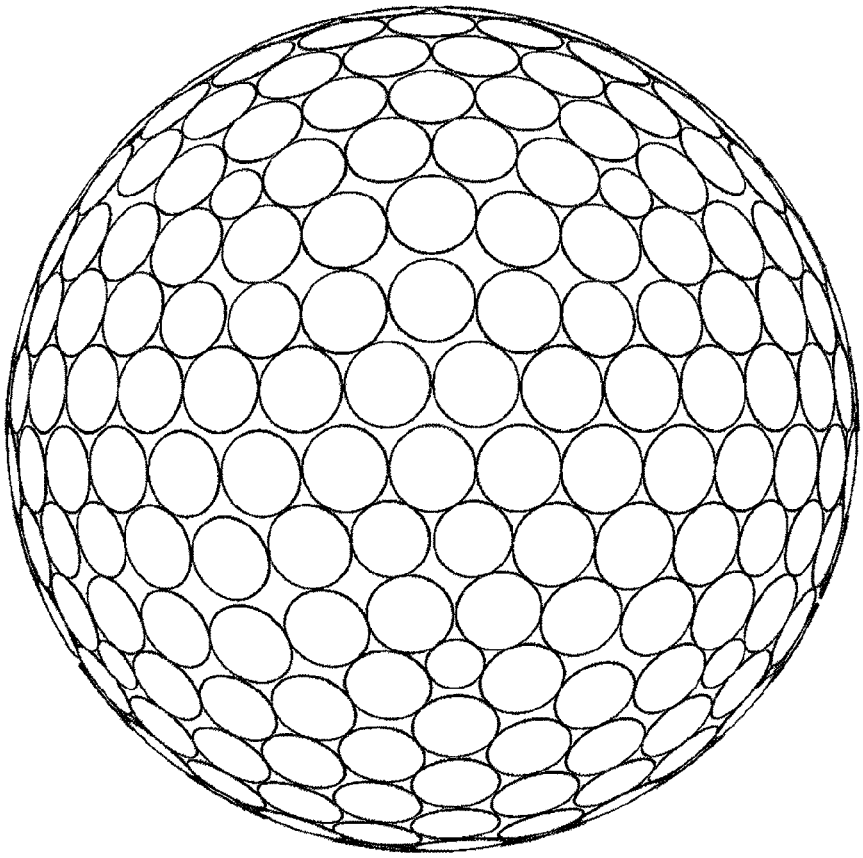
FIG. 10 is a front view of the golf ball in FIG. 9.
Figure 11:
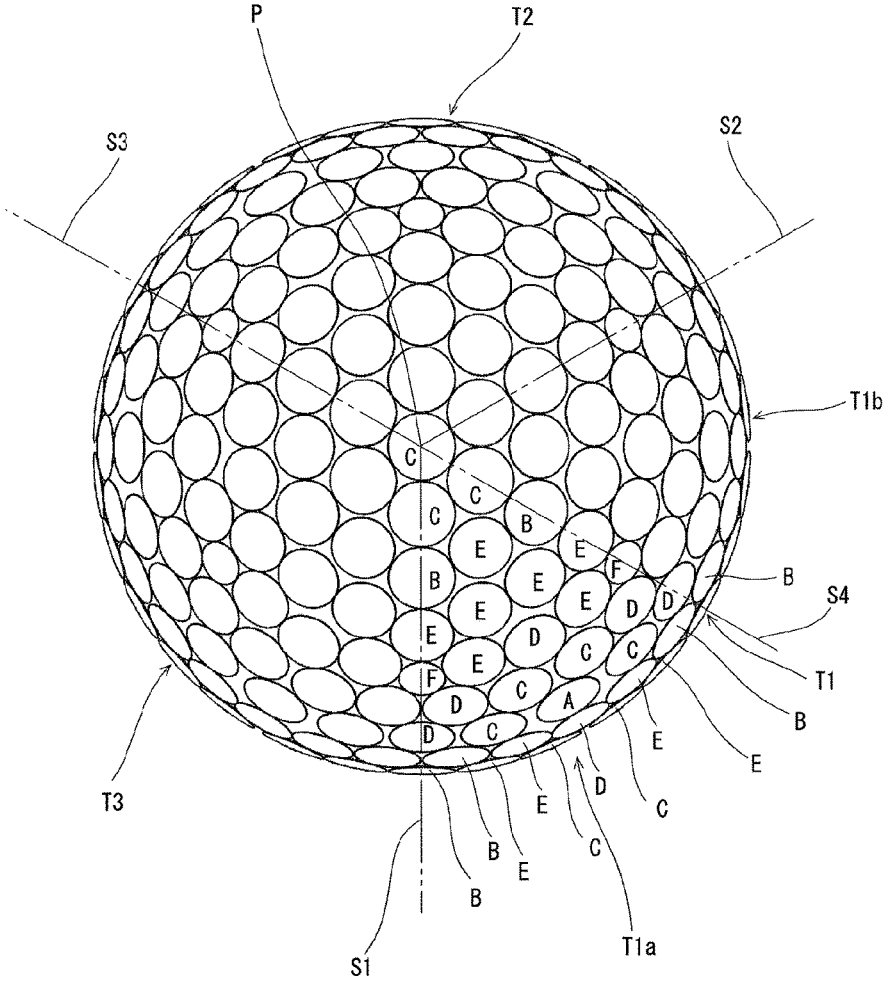
FIG. 11 is a plan view of a golf ball according to Example 4 of the present invention.
Figure 12:
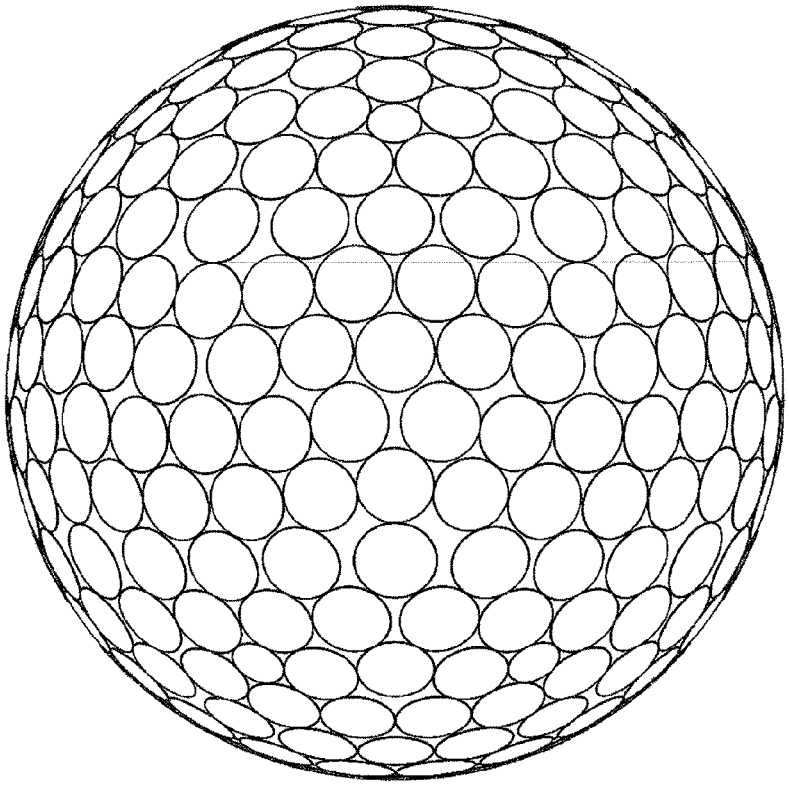
FIG. 12 is a front view of the golf ball in FIG. 11.

| Specifications of Dimples | | | | |
|---|---|---|---|---|
| | D1 | D2 | D3 | D4 |
| Plan view | FIG. 2 | FIG. 7 | FIG. 9 | FIG. 11 |
| Front view | FIG. 3 | FIG. 8 | FIG. 10 | FIG. 12 |
| Number | 324 | 312 | 324 | 338 |
| Number of units | 3 | 3 | 3 | 3 |
| Number of small units | 6 | 6 | 6 | 6 |
| So (%) | 82.4 | 81.9 | 84.4 | 85.4 |
| Rs (%) | 77.8 | 76.9 | 64.8 | 78.7 |
| Rs + 2.5 * So − 273 | 10.80 | 8.65 | 2.80 | 19.20 |
| Mathematical formula (5) | Sa. | Sa. | Sa. | Sa. |
| Rs + 2.5 * So − 278 | 5.80 | 3.65 | −2.20 | 14.20 |
| Mathematical formula (6) | Sa. | Sa. | Unsa. | Sa. |
| Rs + 2.5 * So − 283 | 0.80 | −1.35 | −7.20 | 9.20 |
| Mathematical formula (7) | Sa. | Unsa. | Unsa. | Sa. |
| Rs' (%) | 77.8 | 48.1 | 64.8 | 25.4 |
| Rs' + 2.2 * So − 245 | 14.08 | −16.72 | 5.48 | −31.72 |
| Mathematical formula (8) | Sa. | Unsa. | Sa. | Unsa. |
| Rs' + 2.2 * So − 252 | 7.08 | −23.72 | −1.52 | −38.72 |
| Mathematical formula (9) | Sa. | Unsa. | Unsa. | Unsa. |

Sa.: Satisfied
Unsa.: Unsatisfied

TABLE 7

Figure 13:
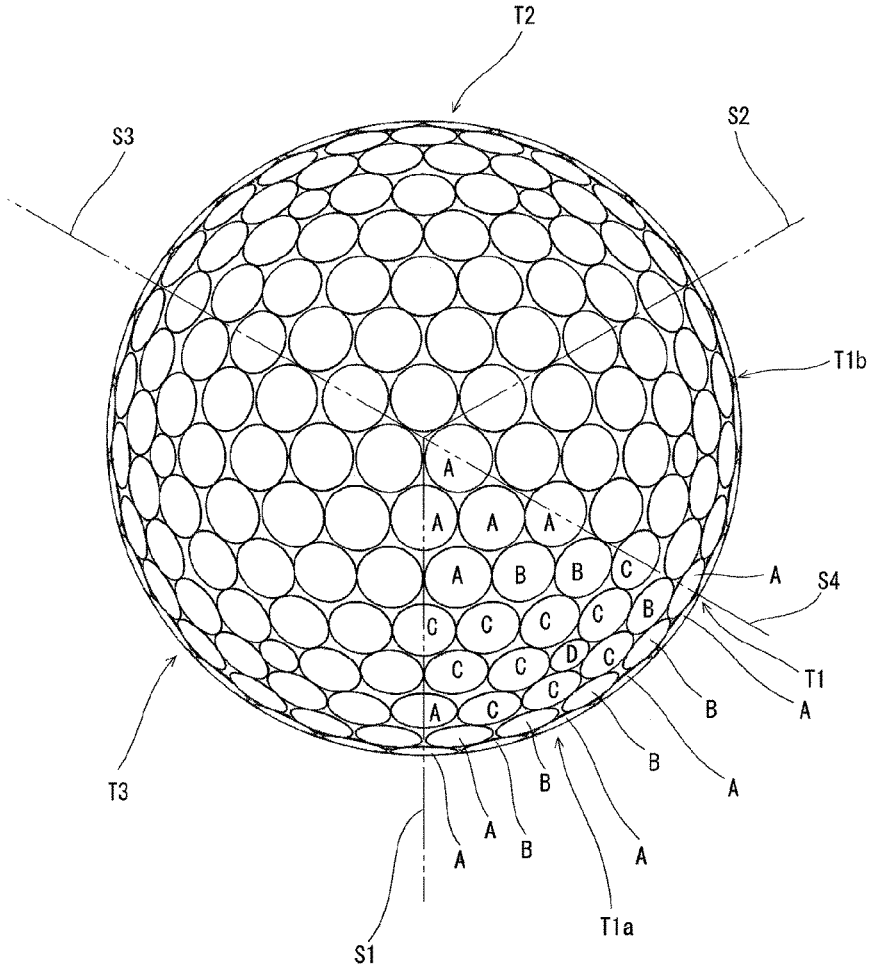
FIG. 13 is a plan view of a golf ball according to Comparative Example 1.
Figure 14:
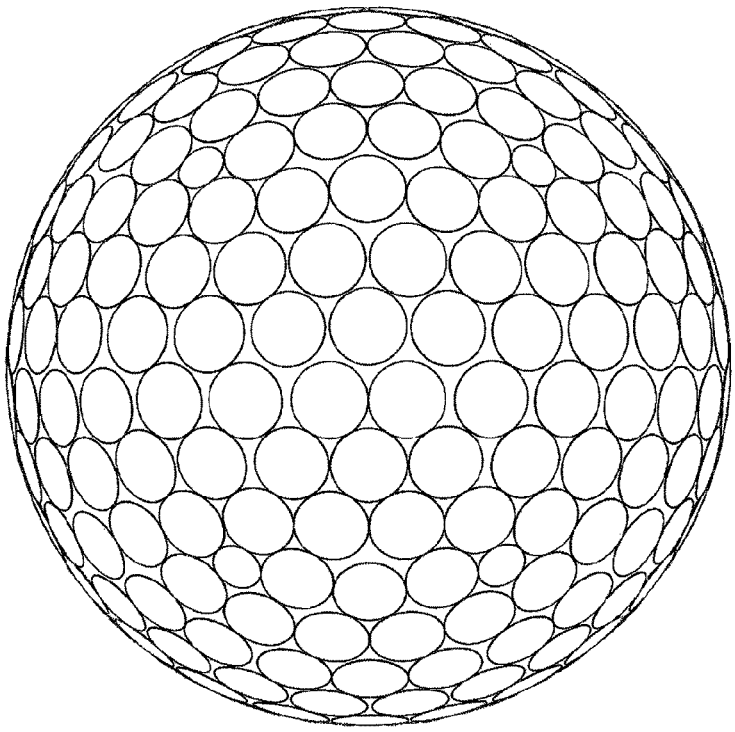
FIG. 14 is a front view of the golf ball in FIG. 13.
Figure 15:
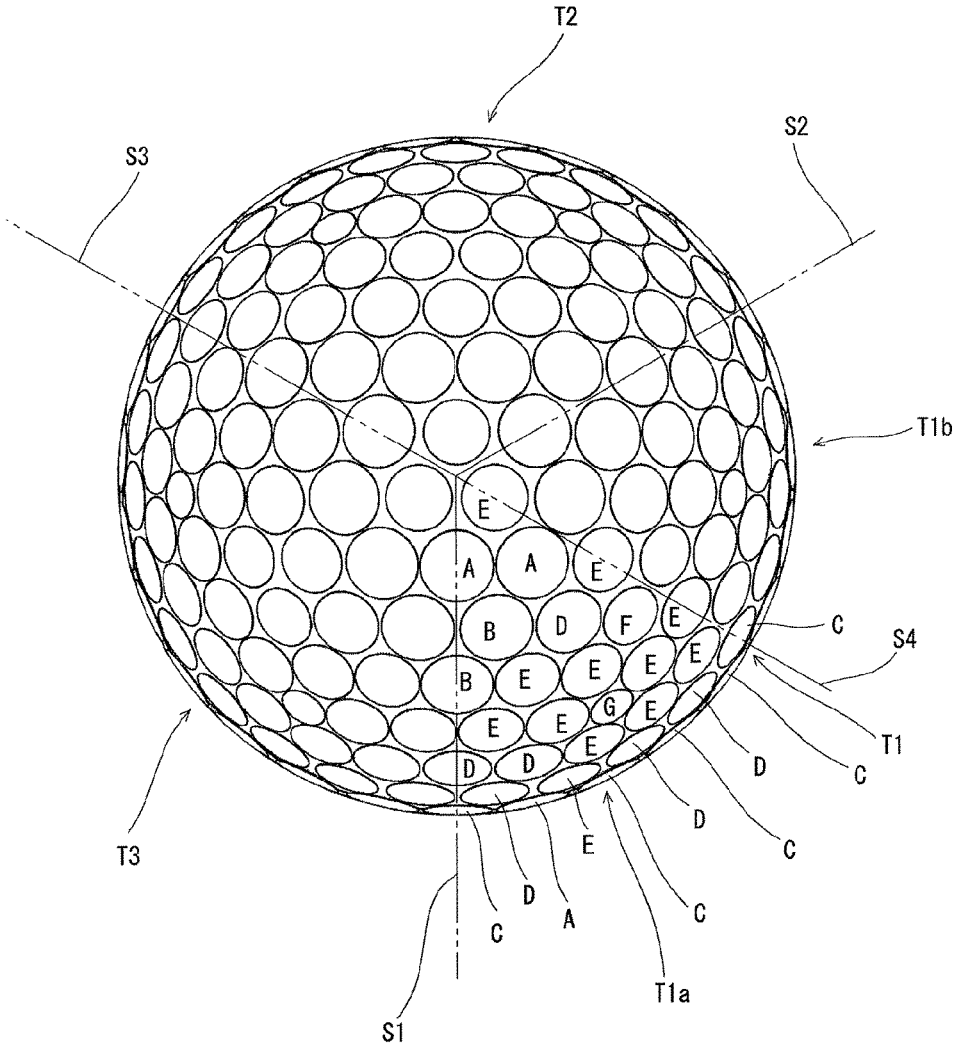
FIG. 15 is a plan view of a golf ball according to Comparative Example 2.
Figure 16:
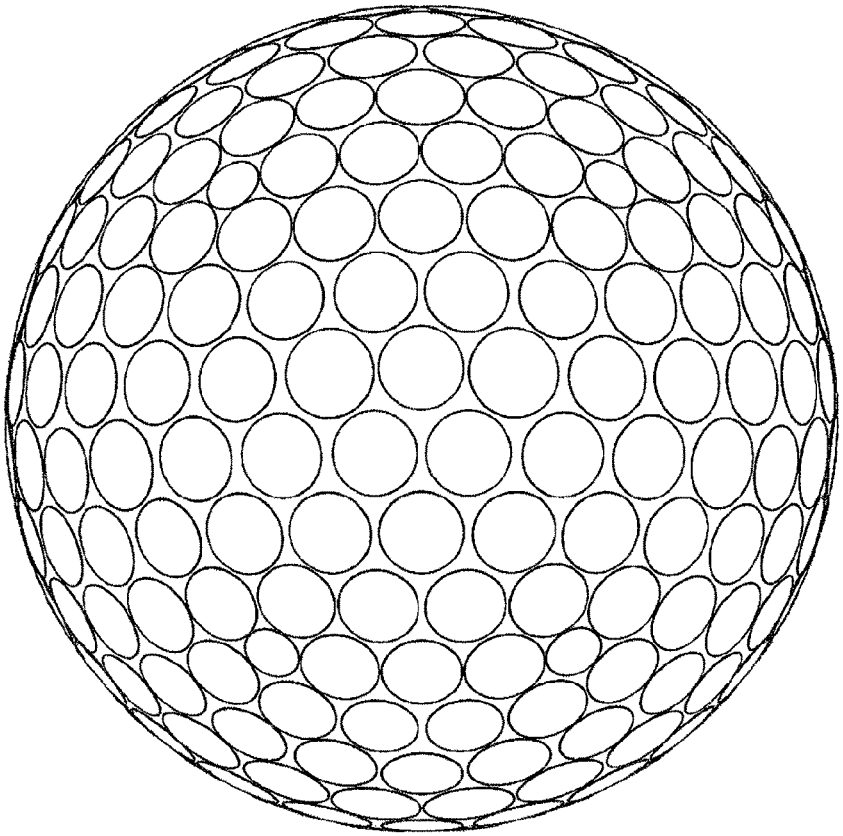
FIG. 16 is a front view of the golf ball in FIG. 15.
Figure 17:
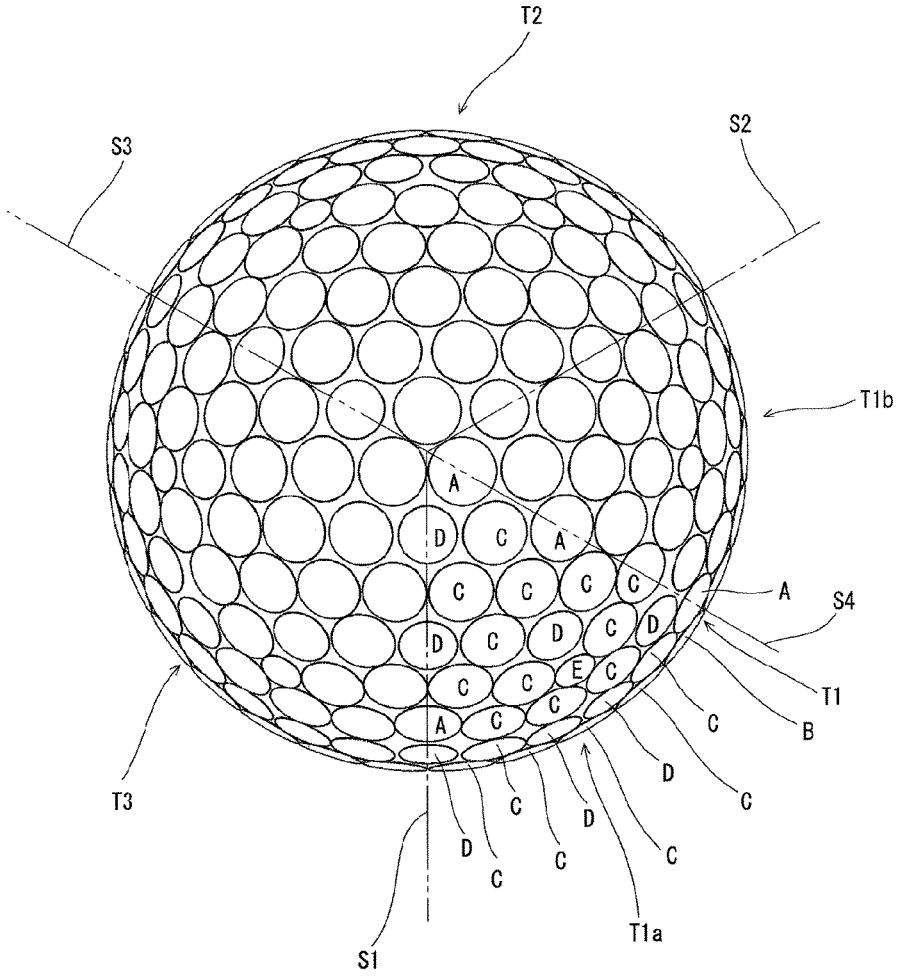
FIG. 17 is a plan view of a golf ball according to Comparative Example 3.
Figure 18:
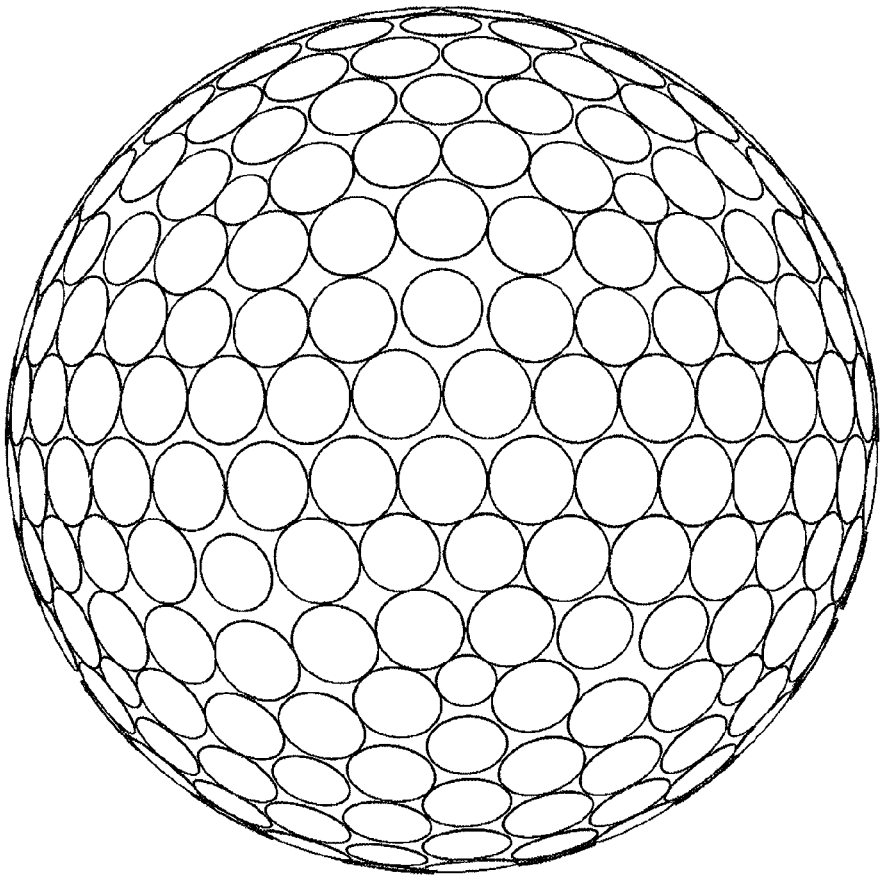
FIG. 18 is a front view of the golf ball in FIG. 17.
Figure 19:
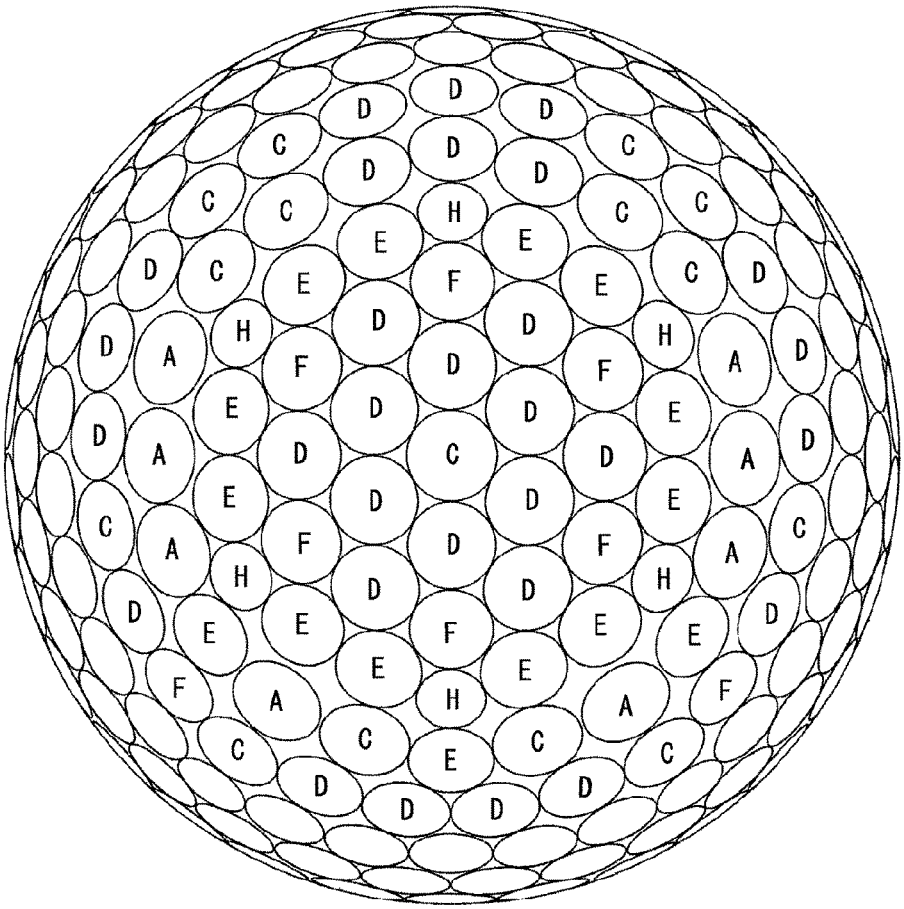
FIG. 19 is a plan view of a golf ball according to Comparative Example 4.
Figure 20:
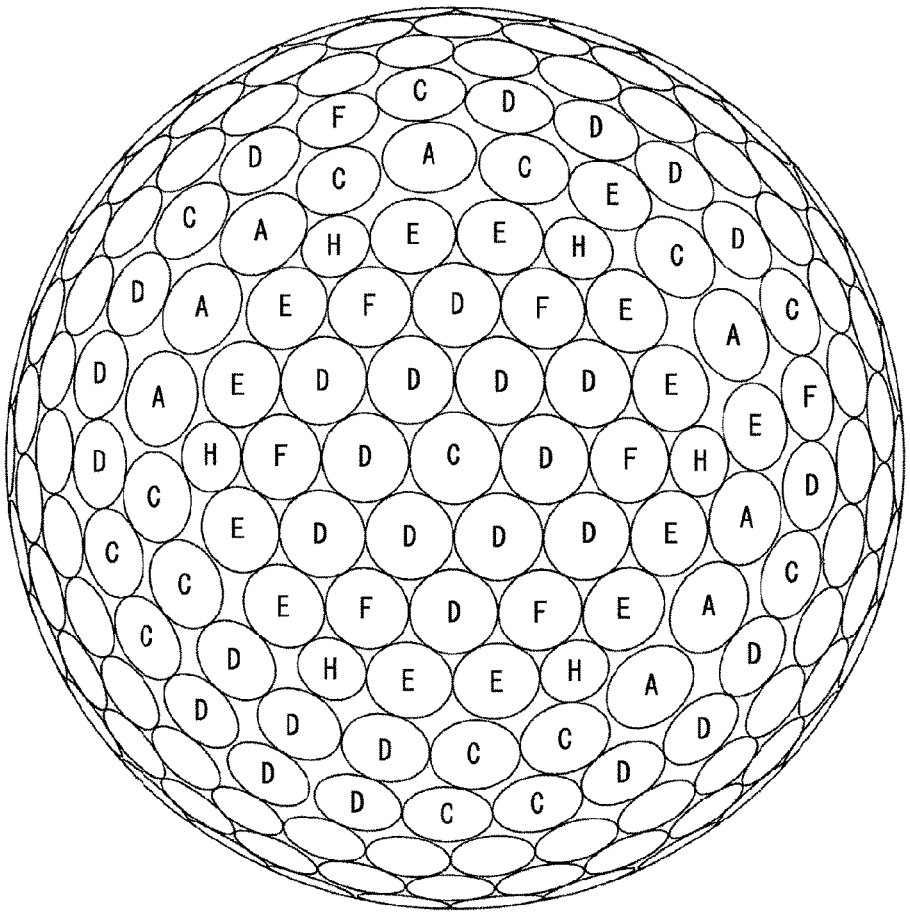
FIG. 20 is a bottom view of the golf ball in FIG. 19.
Figure 21:
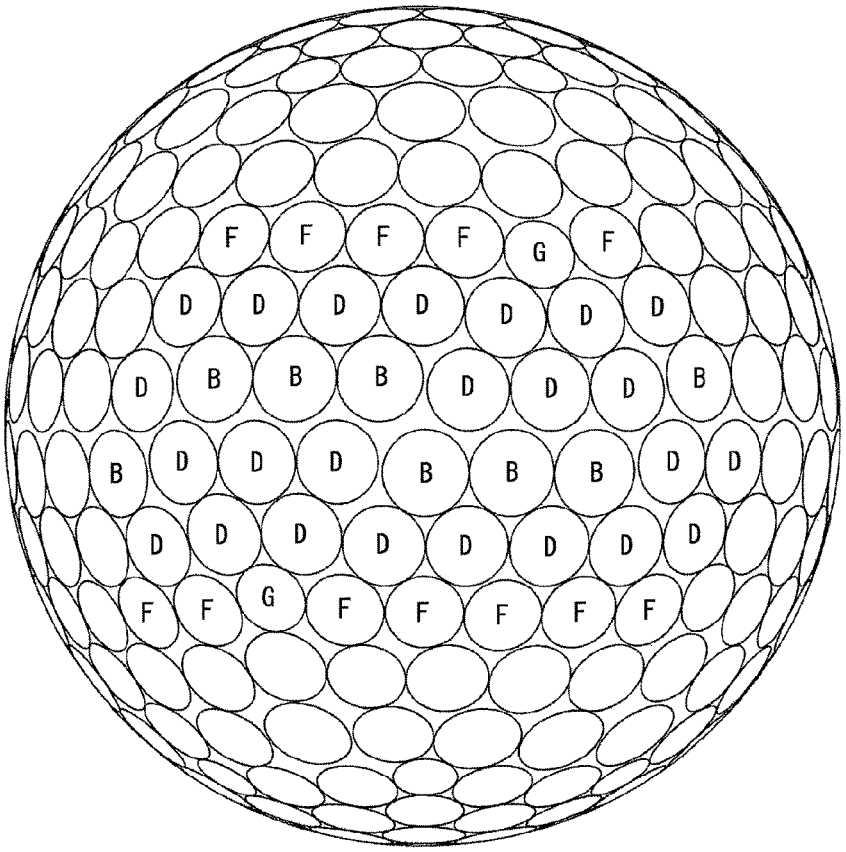
FIG. 21 is a right side view of the golf ball in FIG. 19.
Figure 22:
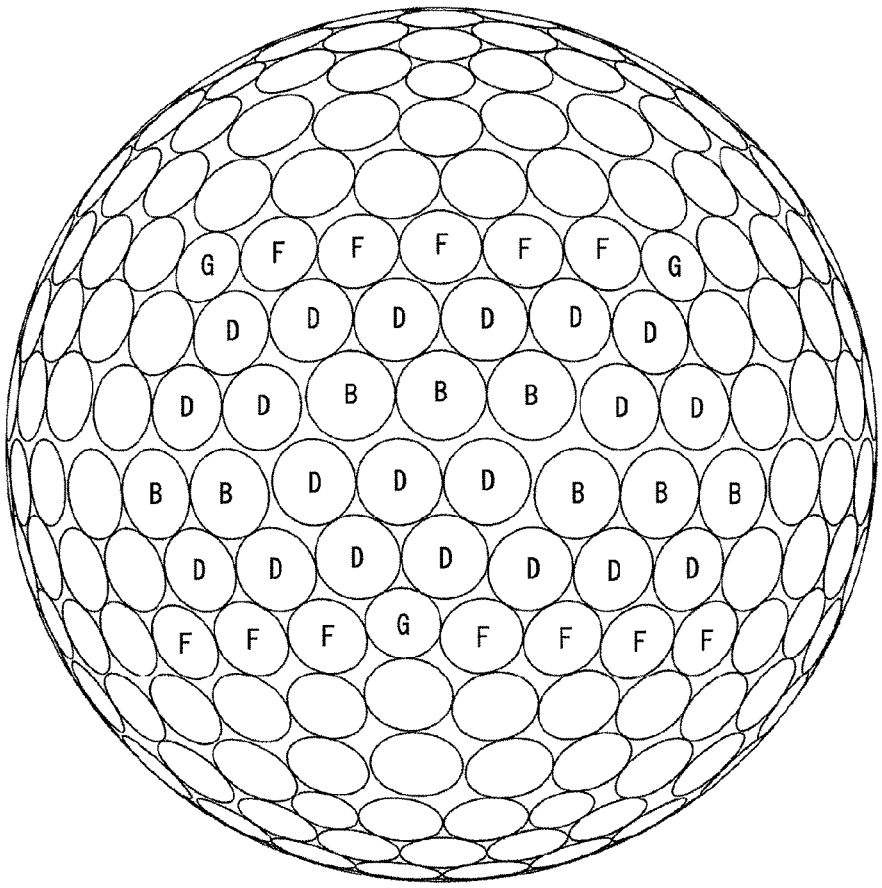
FIG. 22 is a front view of the golf ball in FIG. 19.
Figure 23:
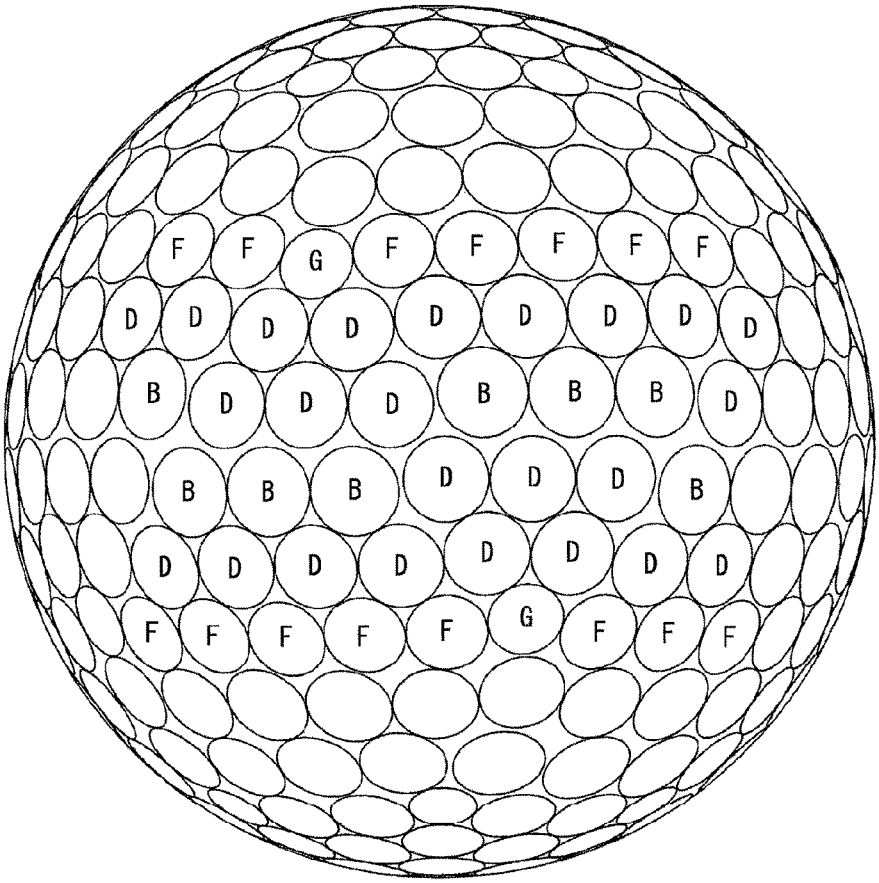
FIG. 23 is a left side view of the golf ball in FIG. 19.
Figure 24:
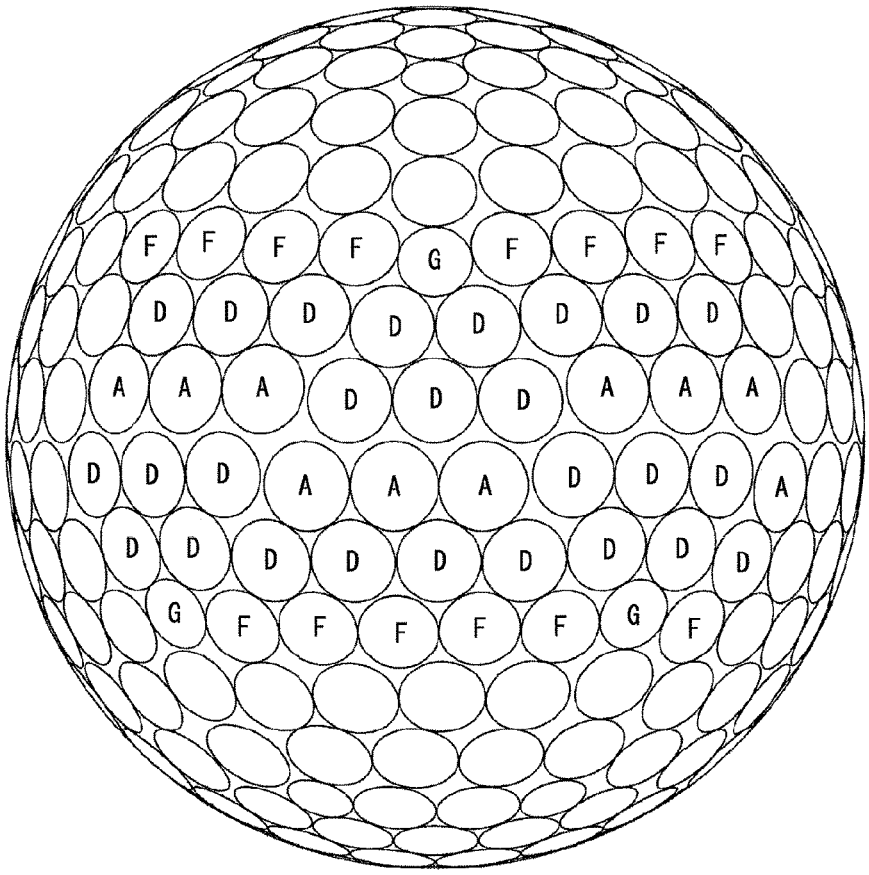
FIG. 24 is a back view of the golf ball in FIG. 19.
Figure 25:
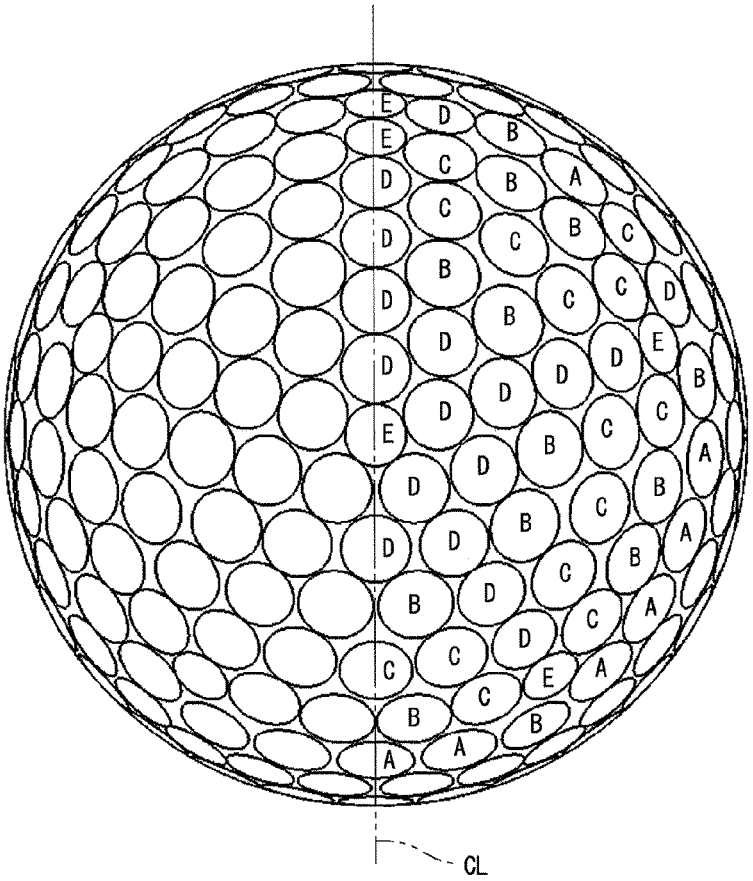
FIG. 25 is a plan view of a golf ball according to Comparative Example 5.

| Specifications of Dimples | | | | | |
|---|---|---|---|---|---|
| | D5 | D6 | D7 | D8 | D9 |
| Plan view | FIG. 13 | FIG. 15 | FIG. 17 | FIG. 19 | FIG. 25 |
| Front view | FIG. 14 | FIG. 16 | FIG. 18 | FIG. 22 | FIG. 26 |
| Number | 312 | 312 | 324 | 344 | 324 |
| Number of units | 3 | 3 | 3 | — | — |
| Number of small units | 6 | 6 | 6 | — | — |
| So (%) | 84.8 | 78.9 | 81.1 | 85.3 | 80.6 |
| Rs (%) | 34.6 | 76.9 | 64.8 | 61.0 | 87.7 |
| Rs + 2.5 * So − 273 | −26.40 | 1.15 | −5.45 | 1.25 | 16.20 |
| Mathematical formula (5) | Unsa. | Sa. | Unsa. | Sa. | Sa. |
| Rs + 2.5 * So − 278 | −31.40 | −3.85 | −10.45 | −3.75 | 11.20 |
| Mathematical formula (6) | Unsa. | Unsa. | Unsa. | Unsa. | Sa. |
| Rs + 2.5 * So − 283 | −36.40 | −8.85 | −15.45 | −8.75 | 6.20 |
| Mathematical formula (7) | Unsa. | Unsa. | Unsa. | Unsa. | Sa. |
| Rs' (%) | 34.6 | 36.5 | 64.8 | 8.7 | 27.2 |
| Rs' + 2.2 * So − 245 | −23.84 | −34.92 | −1.78 | −48.64 | −40.48 |
| Mathematical formula (8) | Unsa. | Unsa. | Unsa. | Unsa. | Unsa. |

TABLE 7-continued

| Specifications of Dimples | | | | | |
|---|---|---|---|---|---|
| | D5 | D6 | D7 | D8 | D9 |
| Rs' + 2.2 * So − 252 | −30.84 | −41.92 | −8.78 | −55.64 | −47.48 |
| Mathematical formula (9) | Unsa. | Unsa. | Unsa. | Unsa. | Unsa. |

Sa.: Satisfied
Unsa.: Unsatisfied

TABLE 8

| Results of Evaluation | | | | |
|---|---|---|---|---|
| | Ex. 2 | Ex. 3 | Ex. 1 | Ex. 4 |
| Core | | | | |
| Composition | I | I | I | I |
| Ho (Shore C) | 48 | 48 | 48 | 48 |
| Hs (Shore C) | 80 | 80 | 80 | 80 |
| Hs − Ho | 32 | 32 | 32 | 32 |
| First mid layer | | | | |
| Composition | (a) | (a) | (a) | (a) |
| Thickness | 1.00 | 1.00 | 1.00 | 1.00 |
| Hardness (Shore C) | 57 | 57 | 57 | 57 |
| Second mid layer | | | | |
| Composition | — | — | — | — |
| Thickness | — | — | — | — |
| hardness (Shore C) | — | — | — | — |
| Cover | — | — | — | — |
| Composition | (e) | (e) | (e) | (e) |
| Tc | 1.05 | 1.05 | 1.05 | 1.05 |
| Hardness (Shore C) | 92 | 92 | 92 | 92 |
| Dimples | D2 | D3 | D1 | D4 |
| Sb | 3.66 | 3.66 | 3.66 | 3.66 |
| Hs − Ho | 32 | 32 | 32 | 32 |
| Hc − Hm (min) | 35 | 35 | 35 | 35 |
| Hm (min) − Ho | 9 | 9 | 9 | 9 |
| Hc − Hs | 12 | 12 | 12 | 12 |
| TT (mm) | 2.05 | 2.05 | 2.05 | 2.05 |
| Ball speed (m/s) | 57.70 | 57.70 | 57.70 | 57.70 |
| Spin (rpm) | 2500 | 2500 | 2500 | 2500 |
| Flight distance (m) | 199.0 | 199.2 | 199.3 | 199.2 |
| Feel at impact | A | A | A | A |

TABLE 9

| Results of Evaluation | | | | | |
|---|---|---|---|---|---|
| | Comp. Ex. 1 | Comp. Ex. 2 | Comp. Ex. 3 | Comp. Ex. 4 | Comp. Ex. 5 |
| Core | | | | | |
| Composition | I | I | I | I | I |
| Ho (Shore C) | 48 | 48 | 48 | 48 | 48 |
| Hs (Shore C) | 80 | 80 | 80 | 80 | 80 |
| Hs − Ho | 32 | 32 | 32 | 32 | 32 |
| First mid layer | | | | | |
| Composition | (a) | (a) | (a) | (a) | (a) |
| Thickness | 1.00 | 1.00 | 1.00 | 1.00 | 1.00 |
| Hardness (Shore C) | 57 | 57 | 57 | 57 | 57 |
| Second mid layer | | | | | |
| Composition | — | — | — | — | — |
| Thickness | — | — | — | — | — |
| Hardness (Shore C) | — | — | — | — | — |
| Cover | — | — | — | — | — |
| Composition | (e) | (e) | (e) | (e) | (e) |
| Tc | 1.05 | 1.05 | 1.05 | 1.05 | 1.05 |

TABLE 9-continued

| Results of Evaluation | Comp. Ex. 1 | Comp. Ex. 2 | Comp. Ex. 3 | Comp. Ex. 4 | Comp. Ex. 5 |
|---|---|---|---|---|---|
| Hardness (Shore C) | 92 | 92 | 92 | 92 | 92 |
| Dimples | D5 | D6 | D7 | D8 | D9 |
| Sb | 3.66 | 3.66 | 3.66 | 3.66 | 3.66 |
| Hs − Ho | 32 | 32 | 32 | 32 | 32 |
| Hc − Hm (min) | 35 | 35 | 35 | 35 | 35 |
| Hm (min) − Ho | 9 | 9 | 9 | 9 | 9 |
| Hc − Hs | 12 | 12 | 12 | 12 | 12 |
| TT (mm) | 2.05 | 2.05 | 2.05 | 2.05 | 2.05 |
| Ball speed (m/s) | 57.70 | 57.70 | 57.70 | 57.70 | 57.70 |
| Spin (rpm) | 2500 | 2500 | 2500 | 2500 | 2500 |
| Flight distance (m) | 197.2 | 197.3 | 198.7 | 198.6 | 196.3 |
| Feel at impact | A | A | A | A | A |

TABLE 10

| Results of Evaluation | Ex. 5 | Ex. 6 | Comp. Ex. 6 | Comp. Ex. 7 |
|---|---|---|---|---|
| Core | | | | |
| Composition | II | III | IV | V |
| Ho (Shore C) | 46 | 50 | 58 | 46 |
| Hs (Shore C) | 78 | 82 | 90 | 78 |
| Hs − Ho | 32 | 32 | 32 | 32 |
| First mid layer | | | | |
| Composition | (a) | (a) | (b) | (a) |
| Thickness | 1.00 | 1.00 | 1.00 | 1.00 |
| Hardness (Shore C) | 57 | 57 | 54 | 57 |
| Second mid layer | | | | |
| Composition | — | — | — | — |
| Thickness | — | — | — | — |
| Hardness (Shore C) | — | — | — | — |
| Cover | — | — | — | — |
| Composition | (e) | (e) | (e) | (c) |
| Tc | 1.05 | 1.05 | 1.05 | 1.05 |
| Hardness (Shore C) | 92 | 92 | 92 | 83 |
| Dimples | D1 | D1 | D1 | D1 |
| Sb | 3.96 | 3.37 | 2.60 | 3.66 |
| Hs − Ho | 32 | 32 | 32 | 32 |
| Hc − Hm (min) | 35 | 35 | 38 | 26 |
| Hm (min) − Ho | 11 | 7 | −4 | 11 |
| Hc − Hs | 14 | 10 | 2 | 5 |
| TT (mm) | 2.05 | 2.05 | 2.05 | 2.05 |
| Ball speed (m/s) | 57.55 | 57.85 | 58.38 | 57.51 |
| Spin (rpm) | 2400 | 2600 | 2950 | 2675 |
| Flight distance (m) | 199.6 | 199.1 | 198.3 | 196.8 |
| Feel at impact | A | B | D | A |

TABLE 11

| Results of Evaluation | Ex. 7 | Comp. Ex. 8 | Comp. Ex. 9 | Ex. 8 |
|---|---|---|---|---|
| Core | | | | |
| Composition | II | II | VI | V |
| Ho (Shore C) | 49 | 48 | 60 | 49 |
| Hs (Shore C) | 81 | 80 | 70 | 81 |
| Hs − Ho | 32 | 32 | 10 | 32 |
| First mid layer | | | | |
| Composition | (a) | (c) | (a) | (a) |
| Thickness | 1.00 | 1.00 | 1.00 | 1.00 |
| Hardness (Shore C) | 57 | 83 | 57 | 57 |

TABLE 11-continued

| Results of Evaluation | Ex. 7 | Comp. Ex. 8 | Comp. Ex. 9 | Ex. 8 |
|---|---|---|---|---|
| Second mid layer | | | | |
| Composition | — | — | — | — |
| Thickness | — | — | — | — |
| Hardness (Shore C) | — | — | — | — |
| Cover | — | — | — | — |
| Composition | (g) | (e) | (e) | (e) |
| Tc | 1.05 | 1.05 | 1.05 | 1.4 |
| Hardness (Shore C) | 97 | 92 | 92 | 92 |
| Dimples | D1 | D1 | D1 | D1 |
| Sb | 3.66 | 3.66 | 3.66 | 3.57 |
| Hs − Ho | 32 | 32 | 10 | 32 |
| Hc − Hm (min) | 40 | 9 | 35 | 35 |
| Hm (min) − Ho | 8 | 35 | −3 | 8 |
| Hc − Hs | 16 | 12 | 22 | 11 |
| TT (mm) | 2.05 | 2.05 | 2.05 | 2.40 |
| Ball speed (m/s) | 57.96 | 57.80 | 57.97 | 57.76 |
| Spin (rpm) | 2400 | 2580 | 2860 | 2550 |
| Flight distance (m) | 201.4 | 199.1 | 197.3 | 199.1 |
| Feel at impact | C | D | B | B |

TABLE 12

| Results of Evaluation | Comp. Ex 10 | Ex. 9 | Comp. Ex 11 | Comp. Ex 12 |
|---|---|---|---|---|
| Core | | | | |
| Composition | VII | II | I | II |
| Ho (Shore C) | 66 | 46 | 48 | 46 |
| Hs (Shore C) | 83 | 78 | 80 | 78 |
| Hs − Ho | 17 | 32 | 32 | 32 |
| First mid layer | | | | |
| Composition | (b) | (a) | (a) | (d) |
| Thickness | 1.00 | 1.00 | 1.40 | 1.40 |
| Hardness (Shore C) | 54 | 57 | 57 | 70 |
| Second mid layer | | | | |
| Composition | — | (c) | — | — |
| Thickness | — | 1.00 | — | — |
| Hardness (Shore C) | — | 83 | — | — |
| Cover | — | | — | — |
| Composition | (f) | (e) | (c) | (e) |
| Tc | 1.05 | 1.05 | 1.5 | 1.5 |
| Hardness (Shore C) | 87 | 92 | 83 | 92 |
| Dimples | D1 | D1 | D1 | D1 |
| Sb | 2.60 | 3.66 | 3.66 | 3.66 |
| Hs − Ho | 17 | 32 | 32 | 32 |
| Hc − Hm (min) | 33 | 35 | 26 | 22 |
| Hm (min) − Ho | −12 | 11 | 9 | 24 |
| Hc − Hs | 4 | 14 | 3 | 14 |
| TT (mm) | 2.05 | 3.05 | 2.90 | 2.90 |
| Ball speed (m/s) | 58.22 | 57.68 | 57.69 | 57.69 |
| Spin (rpm) | 3250 | 2515 | 2900 | 2750 |
| Flight distance (m) | 194.8 | 199.1 | 195.6 | 197.0 |
| Feel at impact | D | C | C | C |

As shown in Tables 8 to 12, the golf ball of each Example is excellent in flight performance upon a shot with a driver and feel at impact upon putting. From the results of evaluation, advantages of the present invention are clear.

The golf ball according to the present invention is suitable for, for example, playing golf on golf courses and practicing at driving ranges. The above descriptions are merely illustrative examples, and various modifications can be made without departing from the principles of the present invention.

What is claimed is:

1. A golf ball comprising a core, one or more mid layers positioned outside the core, and a cover positioned outside the mid layers, wherein a Shore C hardness Ho at a central point of the core, a Shore C hardness Hs at a surface of the core, a Shore C hardness Hm(min) of a layer having a lowest hardness among the mid layers, and a Shore C hardness Hc of the cover satisfy the following mathematical formulas (1) to (4), $$Hs-Ho>15 \quad (1),$$

$$Hc-Hm(\min)>20 \quad (2),$$

$$-10<Hm(\min)-Ho<15 \quad (3), \text{ and}$$

$$5<Hc-Hs<20 \quad (4),$$

the hardness Hc of the cover is higher than a Shore C hardness Hm(max) of a layer having a highest hardness among the mid layers, the golf ball has a plurality of dimples on a surface thereof, a ratio So of a sum of areas of the dimples relative to a surface area of a phantom sphere of the golf ball is not less than 81.0%, a ratio Rs of a number of the dimples each having a diameter of not less than 9.60% and not greater than 10.37% of a diameter of the golf ball, relative to a total number of the dimples, is not less than 50%, a dimple pattern of each hemisphere of the phantom sphere includes three units that are rotationally symmetrical to each other, a dimple pattern of each unit includes two small units that are mirror-symmetrical to each other, and the golf ball satisfies the following mathematical formula (5):

$$Rs\geq-2.5*So+273 \quad (5),$$

wherein a ratio Rs' of a number of the dimples each having a diameter of not less than 10.10% and not greater than 10.37% of the diameter of the golf ball, relative to the total number of the dimples, is not less than 50%, and the golf ball satisfies the following mathematical formula (8):

$$Rs'\geq-2.2*So+245 \quad (8).$$

2. The golf ball according to claim 1, wherein a sum of a thickness of the cover and thicknesses of all the mid layers is not greater than 2.8 mm.

3. The golf ball according to claim 1, wherein the golf ball satisfies the following mathematical formula (6):

$$Rs\geq-2.5*So+278 \quad (6).$$

4. The golf ball according to claim 3, wherein the golf ball satisfies the following mathematical formula (7):

$$Rs\geq-2.5*So+283 \quad (7).$$

5. The golf ball according to claim 1, wherein the golf ball satisfies the following mathematical formula (9):

$$Rs'\geq-2.2*So+252 \quad (9).$$

6. The golf ball according to claim 1, wherein a depth of a deepest part of each dimple from a surface of the phantom sphere is not less than 0.10 mm and not greater than 0.65 mm.

7. The golf ball according to claim 1, wherein a total volume of the dimples is not less than 450 $mm^3$ and not greater than 750 $mm^3$.

8. The golf ball according to claim 1, wherein the Shore C hardness Ho at the central point of the core is not less than 40 and not greater than 60, and the Shore C hardness Hs at the surface of the core is not less than 70 and not greater than 90.

9. The golf ball according to claim 1, wherein a difference (Hc−Hm(max)) between the hardness He of the cover and the Shore C hardness Hm(max) of the layer having the highest hardness among the mid layers is not less than 5 and not greater than 45.

* * * * *